US008152037B2

(12) United States Patent
Sabbag

(10) Patent No.: US 8,152,037 B2
(45) Date of Patent: Apr. 10, 2012

(54) TOOL CARRIER

(75) Inventor: Yosi Sabbag, Holon (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 727 days.

(21) Appl. No.: 12/116,622

(22) Filed: May 7, 2008

(65) Prior Publication Data

US 2009/0277937 A1 Nov. 12, 2009

(51) Int. Cl.
*A45F 3/00* (2006.01)

(52) U.S. Cl. ..... 224/584; 224/607; 224/236; 206/373

(58) Field of Classification Search ..... 224/584, 224/904, 429, 42.11, 655, 657, 658, 607, 224/236; D3/228, 905; 206/373
See application file for complete search history.

(56) References Cited

U.S. PATENT DOCUMENTS

| | | | | |
|---|---|---|---|---|
| 2,813,602 | A | 11/1957 | Macarthur, Jr. | |
| 3,717,188 | A | 2/1973 | Green | |
| 3,970,229 | A | 7/1976 | Norinsky | |
| 4,285,556 | A | 8/1981 | Loeffel | 312/244 |
| 4,574,990 | A | 3/1986 | Remis | |
| 4,580,706 | A | 4/1986 | Jackson et al. | |
| 4,718,524 | A | 1/1988 | Crumley | |
| 4,773,535 | A | 9/1988 | Cook | |
| 4,793,508 | A | 12/1988 | Thompson | 220/533 |
| 4,821,853 | A | 4/1989 | Young | |
| 4,854,432 | A | 8/1989 | Carpenter et al. | 190/110 |
| 5,031,807 | A | 7/1991 | Tiffany | |
| 5,050,713 | A | 9/1991 | Lee | |
| 5,209,384 | A | 5/1993 | Anderson | 224/580 |
| 5,361,412 | A | 11/1994 | Perry | |
| 5,628,436 | A | 5/1997 | Jones et al. | |
| D408,137 | S | 4/1999 | Leininger | |
| 5,890,639 | A | 4/1999 | Hancock et al. | |
| 5,947,241 | A | 9/1999 | Rausch | |
| 5,961,018 | A | 10/1999 | Adelbeck et al. | |
| 5,971,101 | A | 10/1999 | Taggart | |
| 5,988,383 | A * | 11/1999 | Armstrong | 206/373 |
| 6,105,764 | A | 8/2000 | Scicluna et al. | 206/320 |
| 6,193,034 | B1 * | 2/2001 | Fournier | 190/107 |
| 6,435,389 | B1 | 8/2002 | Sucher | |
| 6,474,524 | B1 | 11/2002 | Ivarson et al. | 224/653 |

(Continued)

OTHER PUBLICATIONS

Extended European Search Report as issued for European Patent Application No. 09156229.8, dated Jun. 18, 2009.

(Continued)

*Primary Examiner* — Justin Larson
(74) *Attorney, Agent, or Firm* — Pillsbury Winthrop Shaw Pittman LLP

(57) ABSTRACT

A tool bag for transporting a plurality of tools and for positioning over construction apparatus is provided. The tool bag includes a first storage section and a second storage section, at least a flexible cover and a handle. The first and the second storage sections are pivotally connected to each other so as to generally define an upper hinge region. The first and second storage sections are separable so that they can be disposed on opposite sides of the construction apparatus, and being movable into close proximity with one another to enable the tool bag to be carried in a more compact configuration. The flexible cover is constructed and arranged to cover the associated compartments of the storage section. The upper portions of the cover are constructed and arranged to be removed from covering relation while lower portions of the cover remain attached, thereby exposing the compartments.

28 Claims, 20 Drawing Sheets

U.S. PATENT DOCUMENTS

| | | | | |
|---|---|---|---|---|
| 6,571,998 | B2 | 6/2003 | Godshaw et al. | |
| 6,915,902 | B2 | 7/2005 | Brouard | |
| 6,945,442 | B2 | 9/2005 | Godshaw et al. | |
| 2002/0092785 | A1 | 7/2002 | Lungo | |
| 2002/0130151 | A1 | 9/2002 | Godshaw et al. | |
| 2002/0153202 | A1 | 10/2002 | Sawicki et al. | |
| 2004/0040990 | A1 | 3/2004 | Godshaw et al. | |
| 2004/0065573 | A1 | 4/2004 | Brouard | |
| 2004/0188202 | A1 | 9/2004 | Chuang | 190/110 |
| 2004/0238586 | A1 | 12/2004 | Godshaw et al. | 224/625 |
| 2005/0189388 | A1 | 9/2005 | Godshaw et al. | |
| 2008/0121730 | A1 | 5/2008 | Calkin | 238/12 |

OTHER PUBLICATIONS

Extended European Search Report as issued for European Patent Application No. 09159684.1, dated Oct. 14, 2010.

* cited by examiner

TOOL CARRIER

BACKGROUND OF THE INVENTION

Field of the Invention

The present invention relates to a tool bag and, more particularly, to a tool bag for transporting a plurality of tools and for mounting on a construction apparatus such as a ladder, a sawhorse, a scaffold rail, or the like.

When working with or on a construction apparatus, such as a ladder, a saw horse, a scaffold rail, or the like, it is often advantageous to have tools, which are needed for accomplishing a task, readily and easily available within convenient reach. It is also desirable for such tools to be easily transported from one place to another and retrieved easily when needed.

SUMMARY OF THE INVENTION

One aspect of the present invention provides a tool bag for transporting a plurality of tools and for positioning over construction apparatus such as a ladder, a sawhorse, a scaffold rail, or the like. The tool bag includes a first storage section and a second storage section, at least one of the storage sections comprising a flexible cover and a handle. The first storage section and the second storage section are pivotally connected to each other so as to generally define an upper hinge region. The first and second storage sections are separable so that they can be disposed on opposite sides of the construction apparatus, and being movable into close proximity with one another to enable the tool bag to be carried in a more compact configuration. Each of the storage sections comprising a plurality of compartments for storing items. The flexible cover is constructed and arranged to cover the associated compartments of the storage section. The upper portions of the cover are constructed and arranged to be removed from covering relation while lower portions of the cover remain attached, thereby exposing the compartments. The handle is connected in proximity to the upper hinge region to facilitate carrying of the tool bag in the compact configuration.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF THE INVENTION

Figure 1A:
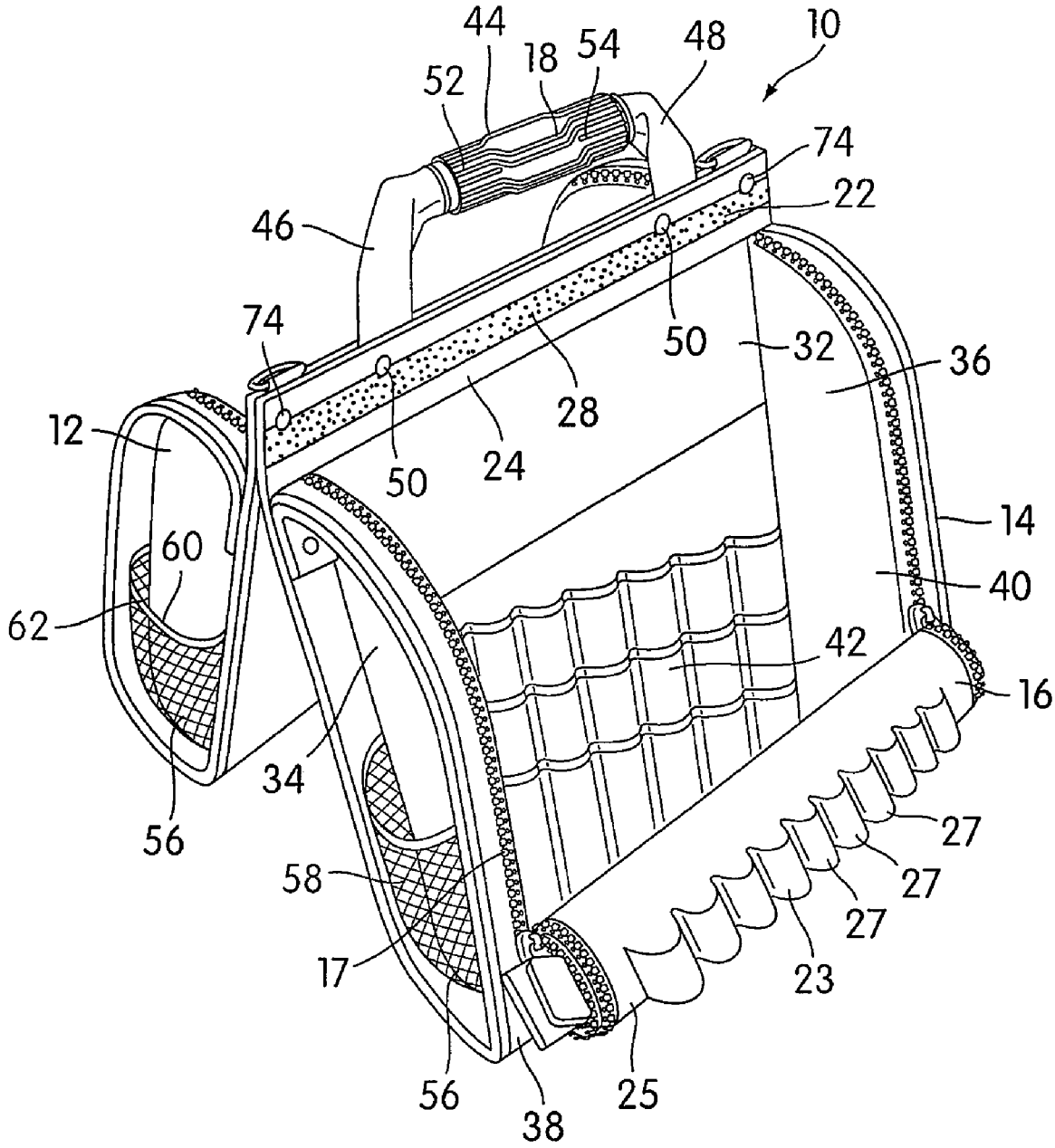
FIG. 1A is a perspective view of a tool bag in accordance with an embodiment of the present invention.
Figure 1B:
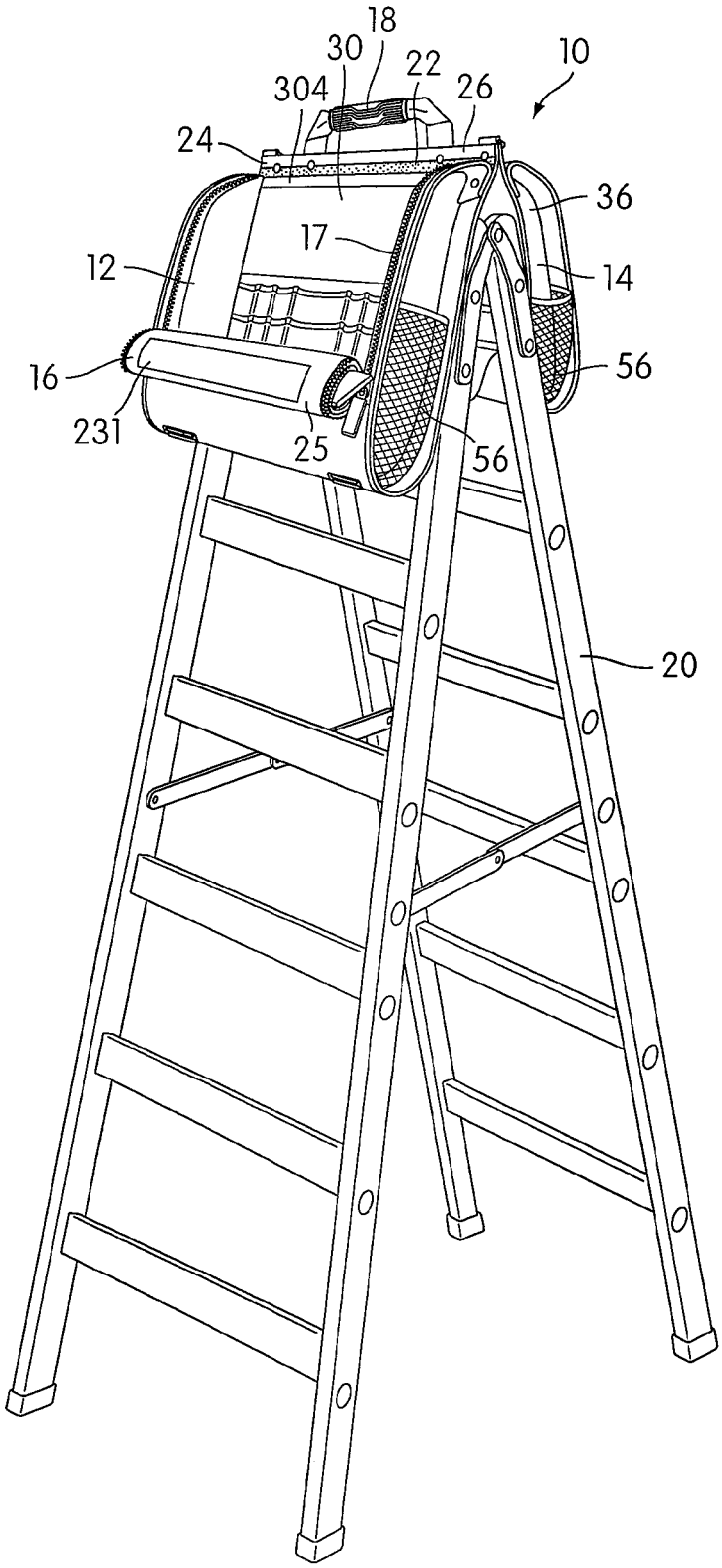
FIG. 1B is a perspective view of the tool bag positioned over a ladder in accordance with an embodiment of the present invention.

FIGS. 1A and 1B show a tool bag 10 in accordance with an embodiment of the present invention. The tool bag 10 is adapted for positioning over construction apparatus 20, such as a ladder, a sawhorse, a scaffold rail, or the like; for carrying tools in standing configuration on a generally planar surface, such as workbench, a work table or the like; and for transporting a plurality of tools from one place to another.

The tool bag 10 may generally include a first storage section 12, a second storage section 14, at least one flexible cover 16, and a handle 18. The first storage section 12 and the second storage section 14 are separable so that they can be disposed on opposite sides of the construction apparatus 20, as shown in FIG. 1B. In the illustrated embodiment, as shown in FIG. 1B, the construction apparatus 20 is a ladder. The first storage section 12 and the second storage section 14 are movable into close proximity with one another to enable the tool bag 10 to be carried in a more compact configuration as will be discussed in detail later with respect to FIG. 4.

Figure 7:
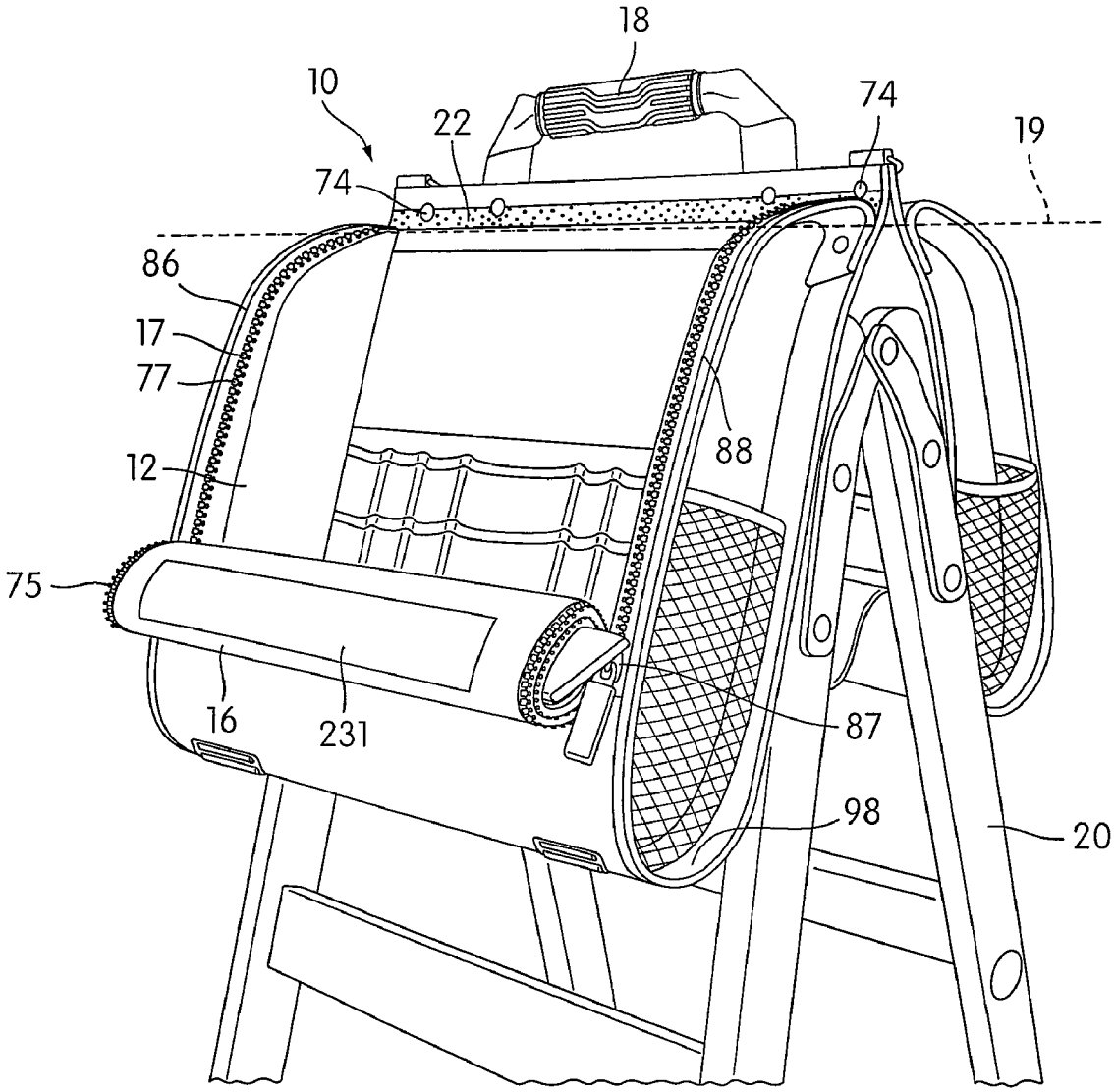
FIG. 7 is a perspective view of the tool bag positioned over the construction apparatus in accordance with an embodiment of the present invention.

The first storage section 12 and the second storage section 14 are pivotally connected to each other so as to define an upper hinge region 22. The hinge region 22 includes a flexible fabric webbing 24. The flexible fabric webbing 24 includes a first webbing 26 and a second webbing 28, which are joined with each, other in the upper portion using a fastening mechanism, such as stitching, adhesive bonding, or any other attachment mechanism as would be appreciated by one skilled in the art. In one embodiment, a panel made of a rigid material (for e.g., plastic or cardboard) is placed in between the first webbing 26 and the second webbing 28 to provide reinforcement in the upper portion of the hinge region 22. A lower portion 304 of the first webbing 26 is connected to an upper portion of a rear wall 30 of the first storage section 12, and a lower portion of the second webbing 28 is connected to an upper portion of a rear wall 32 of the second storage section 14 respectively. A hinge line or axis 19 (as shown in FIG. 7) is formed at the center of the flexible fabric webbing 24 and along the length of the webbing 24 to define the upper hinge region 22. The first storage section 12 and the second storage section 14 generally move or pivot about the hinge line or axis 19 to enable placement of the tool bag 10 on the construction apparatus 20. In one embodiment, the hinge line 19 is formed between the upper and the lower portions of the first and second webbings 26 and 28.

As shown in FIG. 1A, the second storage section 14 includes the rear wall 32, a pair of side walls 34 and 36 extending from the ends of the rear wall 32, and a base wall 38. In one embodiment, the rear wall 32, the side walls 34 and 36, and the base wall 38 are generally rectangular in shape with rounded corners. The rear wall 32, the side walls 34 and 36, and the base wall 38 are interconnected with each other along the length of the adjacent edges (e.g., by a sewn seam) to define an interior area 40 therewithin. In one embodiment, the interior area 40 includes a plurality of compartments 42 for storing items. The structure and configuration of the compartments 42 will be discussed in detail later with respect to the FIGS. 8-11. In one embodiment, optionally any one, all, or any combination of the rear wall 32, the side walls 34 and 36, and the base wall 38, may include a rigid, a semi-rigid, or a flexible (but hard in comparison with fabric) interior panel retained between a pair of fabric panels. In one embodiment, the inner panel is made from plastic or cardboard to provide reinforcement to the walls of the second storage section 14. The pair of fabric panels is sewn together along the respective boundaries to retain the inner panel therewithin. In one embodiment, a cushion material, such as foam is placed in between each fabric panel and the inner panel to provide cushioning characteristics on each side of the walls 32, 34, 36 and 38.

The structure and construction of the first storage section 12 is identical to the second storage section 14, and hence will be not be explained in detail. However, the structure of the compartments located in the interior area 40 of the first storage section 12 are different from the structure of the compartments located in the interior area 40 of the second storage section 14, as will be explained in the discussions later with respect to the FIGS. 8-11.

A flexible cover 16 is constructed and arranged to cover the compartments within an associated one of the storage sections 12 of 14. In one embodiment, the flexible cover 16 is attached to the first storage section 12 or the second storage section 14 by a pair of zippers 17. In another embodiment, the tool bag 10 may include two flexible covers 16, one attached to the first storage section 12 and the other attached to the second storage section 14 as will be described later with respect to FIG. 3. FIG. 1A shows the one of the flexible covers 16 in a completely rolled-down configuration, exposing the compartments 42 located in the interior area 40 of the storage section.

The handle 18 is connected in proximity to the upper hinge region 22 to facilitate carrying of the tool bag 10 in the compact configuration. The handle 18 comprises a grip securing member 44 and a pair of connector members 46 and 48, extending on either side of the grip securing member 44. The pair of connector members 46 and 48 secures the handle 18 to the tool bag 18 using fasteners 50. In one embodiment, the ends of the connector members 46 and 48, which are positioned away from the grip securing member 44, are placed between the first webbing 26 and the second webbing 28 before the first webbing 26 and the second webbing 28 are secured to each other. The handle 18 facilitates a user a secure grip by hand grip 52. The hand grip 52 is attached directly onto the handle 18 and securely conforms to the grip supporting portion 44. In one embodiment, the grip 52 is in a thick, soft foam rubber. In another embodiment, the grip 52 is formed from a relatively rigid elastomeric, rubber based, or plastic material. The grip 52, or its underlying core may have sufficient rigidity to retain generally its shape (subject to slight flexing) when being carried, in spite of the weight of the items carried in the bag 10. In one embodiment, the hand grip 52 is secured to the grip supporting portion 44 using adhesive bonding, or any other attachment mechanism as would be appreciated by one skilled in the art. The hand grip 52 may include a plurality of raised protrusions 54 located along the length of the grip 52. The raised protrusions 54 provide an improved gripping action to the user by defining a slip-resistant surface. In the illustrated embodiment, the raised protrusions 54 are generally in the form of substantially parallel rows of raised protrusions 54 extending from one end to another along the length of the grip 52. It should be appreciated, however, that this embodiment is but one example of different types of handles and grip shapes, configurations and/or constructions that can be provided.

A plurality of outer compartments 56 are located on the side walls 34 and 36 of the second storage section 14. In illustrated embodiment, as shown in FIGS. 1A and 1B, one compartment 56 is located on each side wall 34 and 36 of the second storage section 14. In one embodiment, the compartments 56 are constructed and arranged to be expandable and are configured to support tools or articles on the exterior surface of the side walls 34 and 36 of the second storage section 14. The compartment 56 is generally constructed of a mesh material 58 and may include an elastic strip 60 sewn or otherwise attached along an upper edge 62 of the compartment 56. The elasticity of the elastic strip 60 and the flexibility of the mesh material 58 allow the compartment 56 to be resiliently expanded from its relaxed configuration to accommodate and to support tools or articles of various sizes and shapes. The compartments 56 remain exposed, even when cover(s) 16 is/are closed. The structure of the compartments located on the exterior of side walls on the first storage section 12 is same as the structure of the compartments located on the exterior of side walls on the second storage section 14, and hence will be not described in detail.

Figure 2:
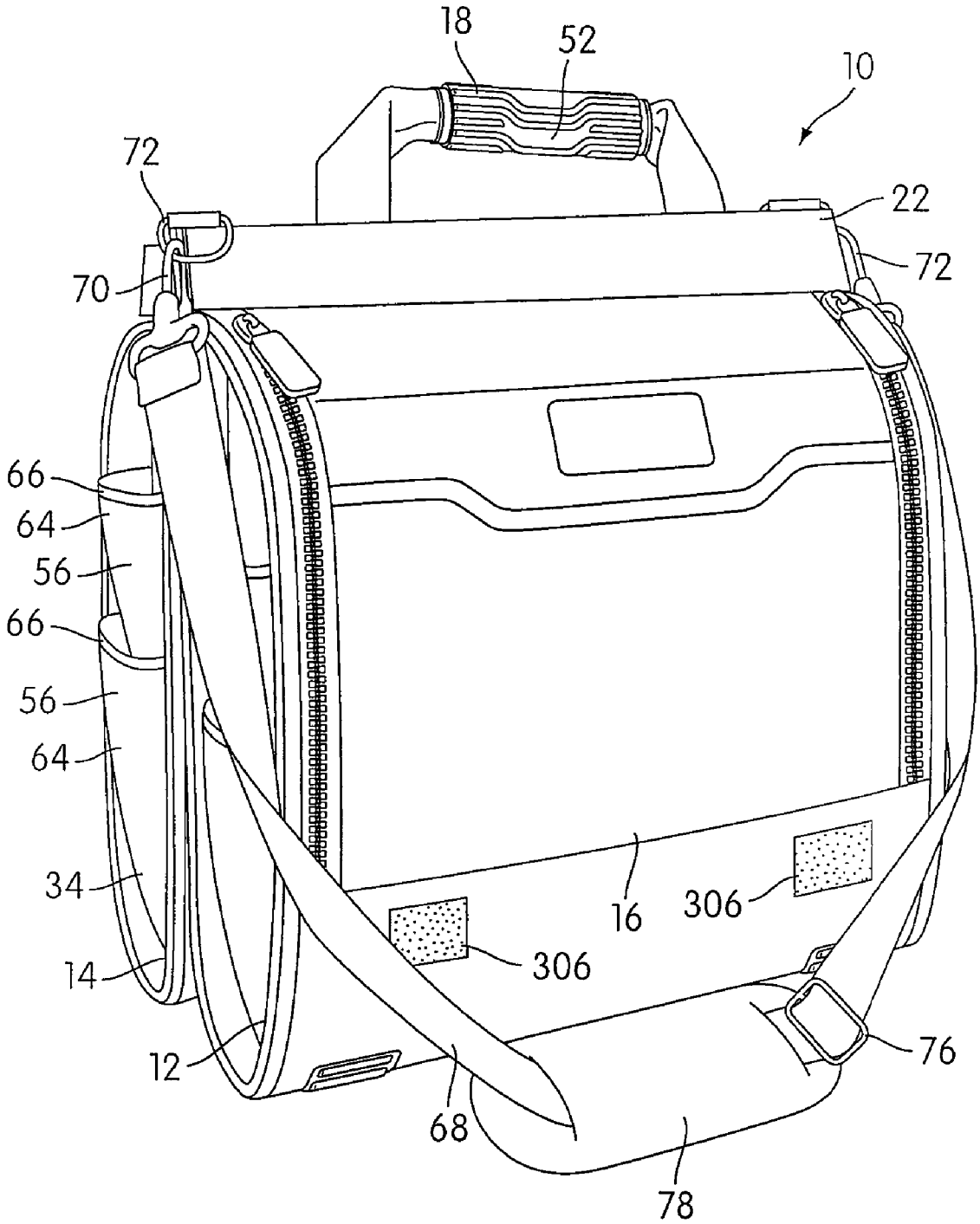
FIG. 2 is a front perspective view of the tool bag in accordance with an embodiment of the present invention.

In one embodiment, as shown in FIG. 2, a plurality of outer side compartments 56 are located on each side wall 34 and 36 (as shown in FIGS. 1A and 1B) of the second storage section 14. The plurality of compartments 56 may include a tiered configuration where compartments are constructed and arranged to be placed in an overlapping relation with each other. In contrast to the compartments 56 described in the previous embodiment, the compartments 56 may not include mesh material 58, but may generally include a solid fabric panel 64 with an optional elastic strip 66 along the upper edge of the compartment 56.

Referring back to FIG. 1A, one or more compartments 23 may be located in an inner surface 25 of the flexible cover 16, which is attached to the second storage section 14. The configuration of one or more compartments 23 can also be seen in FIGS. 10 and 11. In the illustrated embodiment, as shown in FIG. 1A, each compartment 23 may include a plurality of individual containing regions 27 that are configured to be located adjacent to each other in a row and are configured to store articles in the individual containing regions 27. In one embodiment, the compartment 23 is made from an elastic material where it is stitched at regular spaced intervals to form the plurality of individual containing regions 27. The elasticity of the elastic material allows the individual containing regions 27 to be resiliently expanded from its relaxed configuration to accommodate and to support tools or articles of various sizes and shapes. In an alternative embodiment, the compartment 23 may be made of an elastic material that is attached at its ends to the inner surface 25 of the cover 16. The structure of the compartments 23 located on the inner surface 232 of the flexible cover 16 attached to the first storage section 12 (see FIGS. 8 and 9) is same as the structure of the compartments 23 located on the inner surface 25 of the flexible cover 16 attached to the second storage section 14, and hence will be not described in detail.

As shown in FIG. 2, a shoulder strap 68 may be connected in proximity to the upper hinge region 22 to facilitate carrying of the tool bag 10 in the compact configuration. In one embodiment, the strap 68 is constructed and arranged to be detachably secured to the tool bag 10. The shoulder strap 68 may include attachment clips, latches or spring hooks 70 located on both the ends of the shoulder strap 68. The attachment clips or spring hooks 70 may be constructed and arranged to be attached to rings or loops 72 located on the tool bag 10 to releasably secure the shoulder strap 68 with the tool bag 10. The loops 72 are attached on the opposite ends of the upper hinge region 22 using fasteners 74 (as shown in FIGS. 1A and 7). A buckle 76 may be used on the shoulder strap 68 to provide the shoulder strap 68 with adjustable length as is well know in the art. The shoulder strap 68 may further include a cushioned shoulder strap pad 78, for carrying the tool bag 10 on the user's shoulder, attached to or integral with the shoulder strap 68. The shoulder strap 68 may be made from any material and construction, for example, fabric webbing, conventionally used for shoulder straps. In the illustrated embodiment, the shoulder strap pad 78 may include indicia displaying information about the tool bag 10 printed thereon.

Figure 3:
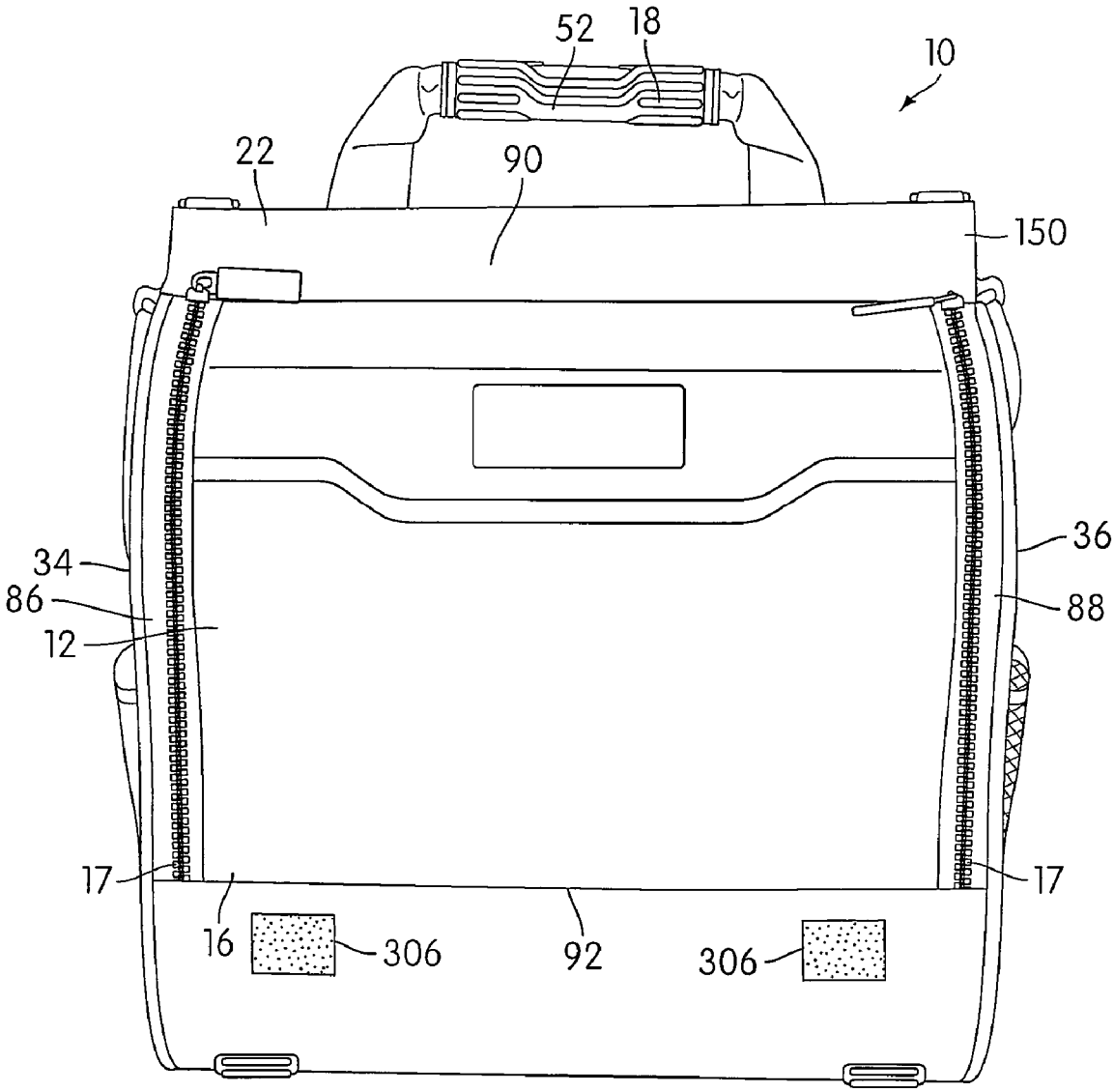
FIG. 3 is a front view of the tool bag in accordance with an embodiment of the present invention.

As shown in FIG. 3, the flexible cover 16 is attached to the first storage section 12 using previously described pair of zippers 17, which are arranged along the length of at least a portion of side edges 86 and 88 of the front wall of the first storage section 12 and on opposite side edges of each cover 16. The zippers 17 do not extend across an upper portion 90 of the flexible cover 16 to facilitate upward extraction of the stored articles, such as tools, from the compartments located in the storage sections 12 and 14 as can be appreciated from FIG. 7. More specifically, the upper region of the space within storage section 12 is not bounded by a mating wall with zipper teeth so that there is no interference with upward removal of tools from the space. The upper edge 150 of the flexible cover is also devoid of zipper teeth. The side zippers 17 retain the upper portions 90 of the cover 16 in covering relation over the associated space within the associated storage section 12 or 14, and can be unzipped so as to be removed from such covering relation when zippers 17 are unzipped, the lower portions 92 of the cover 16 may remain attached, thereby exposing the compartments 42 (as shown in FIG. 1A) located in the storage sections 12 and 14. In one embodiment, the upper edge of cover 16 may be provided with VELCRO that may be connected to a mating VELCRO material provided on the hinge region 22 as will be described later. In another embodiment, the upper edge of the cover 16 is left unconnected, but nevertheless retained in covering relation by virtue of the side zippers 17. The lower edge 152 of the cover 16 may be permanently attached to the tool bag, or in another embodiment, may be removed (such as by a zippered or snap connection). In addition, snap connections, Velcro connections, or other connections can be used to replace the side zippers 17 in the illustrated embodiment.

Figure 4:
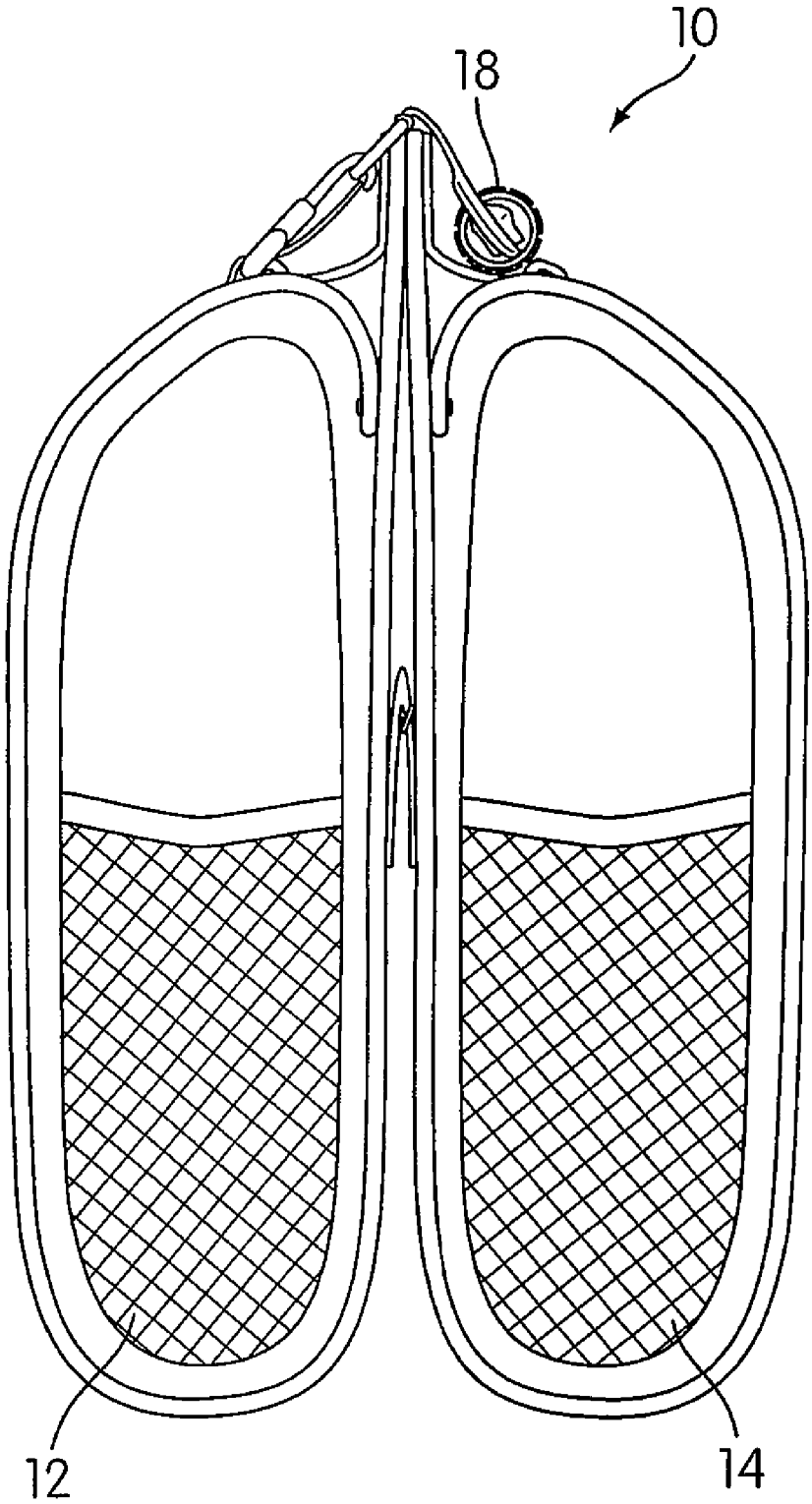
FIG. 4 is a side view of the tool bag in a compact configuration in accordance with an embodiment of the present invention.
Figure 5:
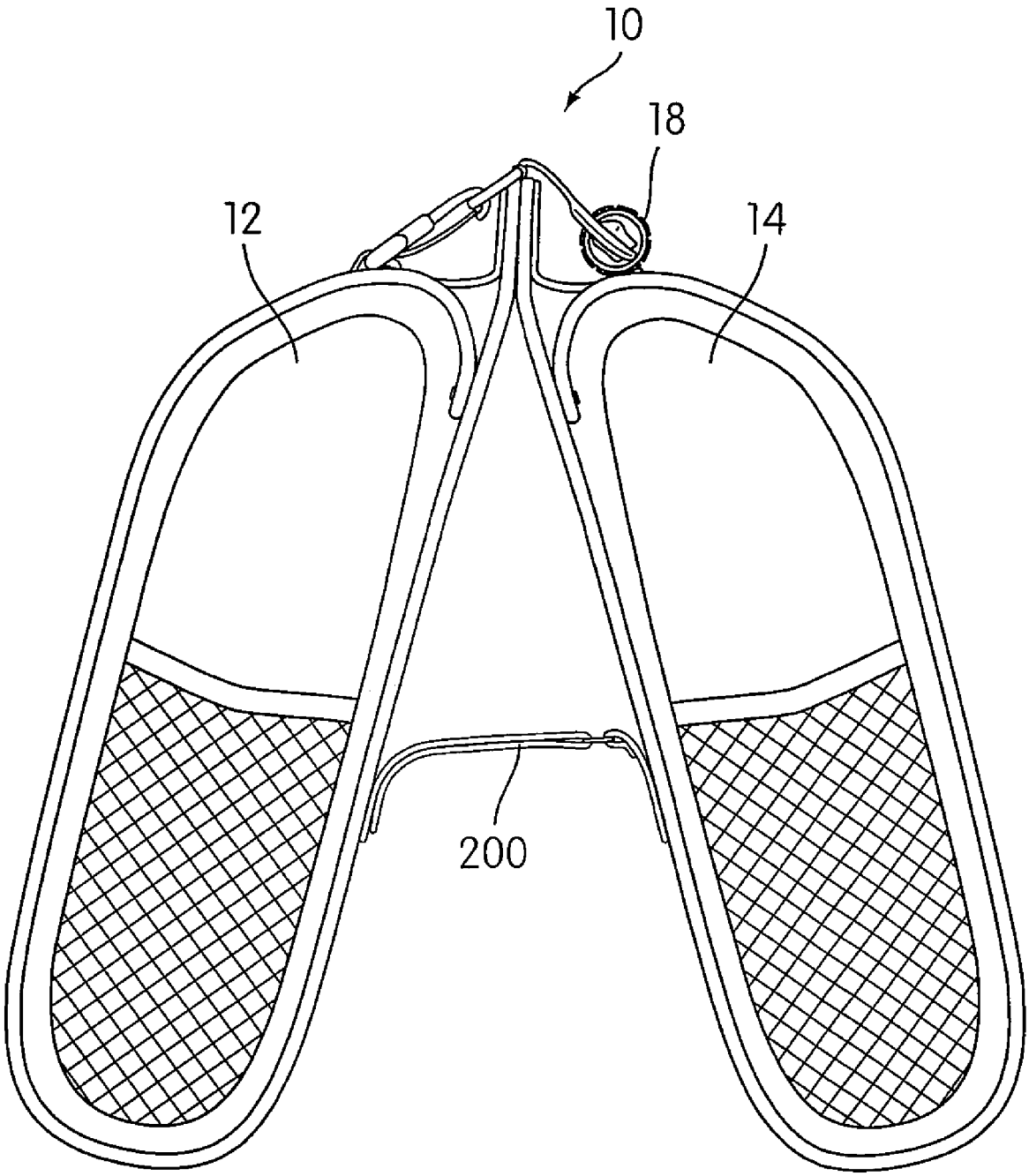
FIG. 5 is a side view of the tool bag in an extended configuration accordance with an embodiment of the present invention.

FIG. 4 shows a side view of the tool bag 10 in a standing and compact configuration, where the first storage section 12 and the second storage section 14 are generally disposed in side-by-side contacting relation to each other. FIG. 5 shows a side view of the tool bag 10 where the tool bag is in a standing and expanded configuration with the first storage section 12 and the second storage section 14 are separated from each other using an adjustable fastening structure 200, as will be explained in detail with respect to FIGS. 12 and 13. The sections 12, 14 will be in a configuration similar to that in FIG. 4 when being carried by handle 18 (i.e., the weight of the compartments 12, 14 bring them into contact with one another)

Figure 6:
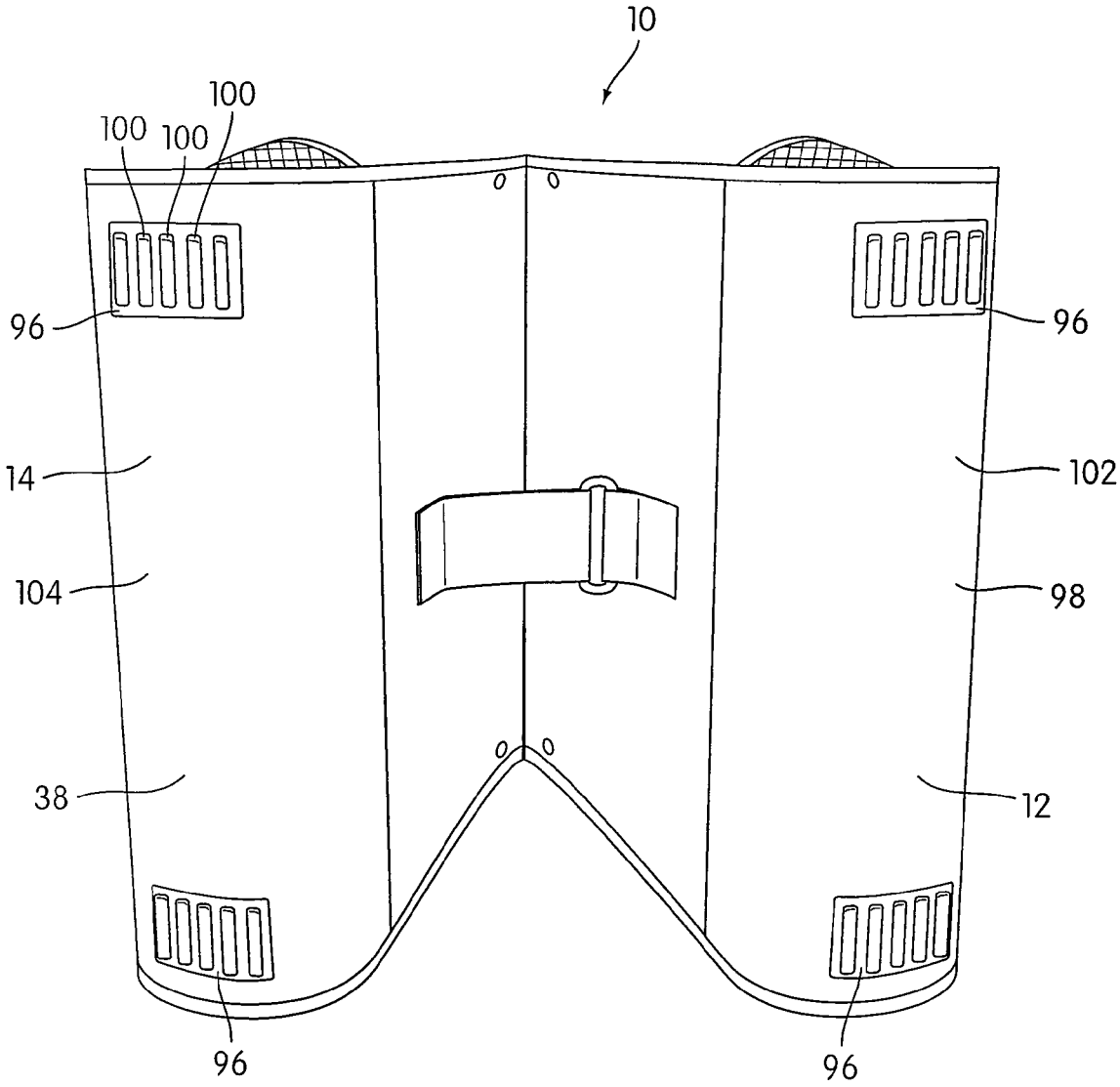
FIG. 6 is a bottom view of the tool bag, where the tool bag in the extended configuration in accordance with an embodiment of the present invention.

As shown in FIG. 6, the tool bag 10 includes a plurality of skid resistant members 96 located on exterior surfaces 102 of a base wall 98 of the first storage section 12, on exterior surfaces 104 of the base wall 38 of the second storage section 14, or on the exterior surfaces of the base walls of both the first and second storage sections 12 and 14 to facilitate stability and balance of the bag 10 when placed in standing configuration on a horizontal support surface such as the floor. In the illustrated embodiment, the skid resistant members 96 are generally rectangular in shape. The skid resistant member 96 may include a plurality of ribs or protrusions 100 that are spaced apart and are disposed generally parallel to each other. In one embodiment, one skid resistant member 96 is attached at the center of the base wall 98 or 38. In the illustrated embodiment, two skid resistant members 96 are attached on opposite ends of the base wall 98 or 38. The plurality of skid resistant members 96 are attached to the exterior surfaces 102 of the base walls 98 of the first storage section 12, the exterior surfaces 104 of the base wall 38 of the second storage section 14, or both external surfaces using adhesive bonding, sewing or other attachment mechanism. In one embodiment, the skid resistant members 96 may be formed of a material with a high coefficient of friction.

FIG. 7 shows a perspective view of the tool bag positioned over the construction apparatus 20. The construction of the upper hinge region 22, as explained in detail earlier with respect to FIGS. 1A and 1B, and the symmetrical structure of the tool bag 10 allows the tool bag 10 to straddle over the construction apparatus 20.

FIG. 7 shows the zipper structure, which attaches the flexible cover 16 to the first storage section 12. The zipper 17 includes a pair of parallel zipper halves 75 and 77. In one embodiment, each zipper half 75 or 77 includes a row of teeth. Each zipper half 75 or 77 is attached along the opposing side edges 86 and 88 of the first storage section 12, and the opposing side edges of the cover 16. A sliding zipper member 87 forces the teeth in each opposing zipper half 75 and 77 into interlocking engagement as the zipper member 87 is pulled from the base wall 98 towards the upper hinge region 22. The zipper halves 75 or 77 are unlocked and are spaced apart when the zipper 17 is opened with the sliding zipper member 87. The structure of the zipper, which attaches the flexible cover 16 to the second storage section 14, is same as the structure of the zipper that attaches the flexible cover 16 to the first storage section 12, and hence will be not described in detail.

Figure 8:
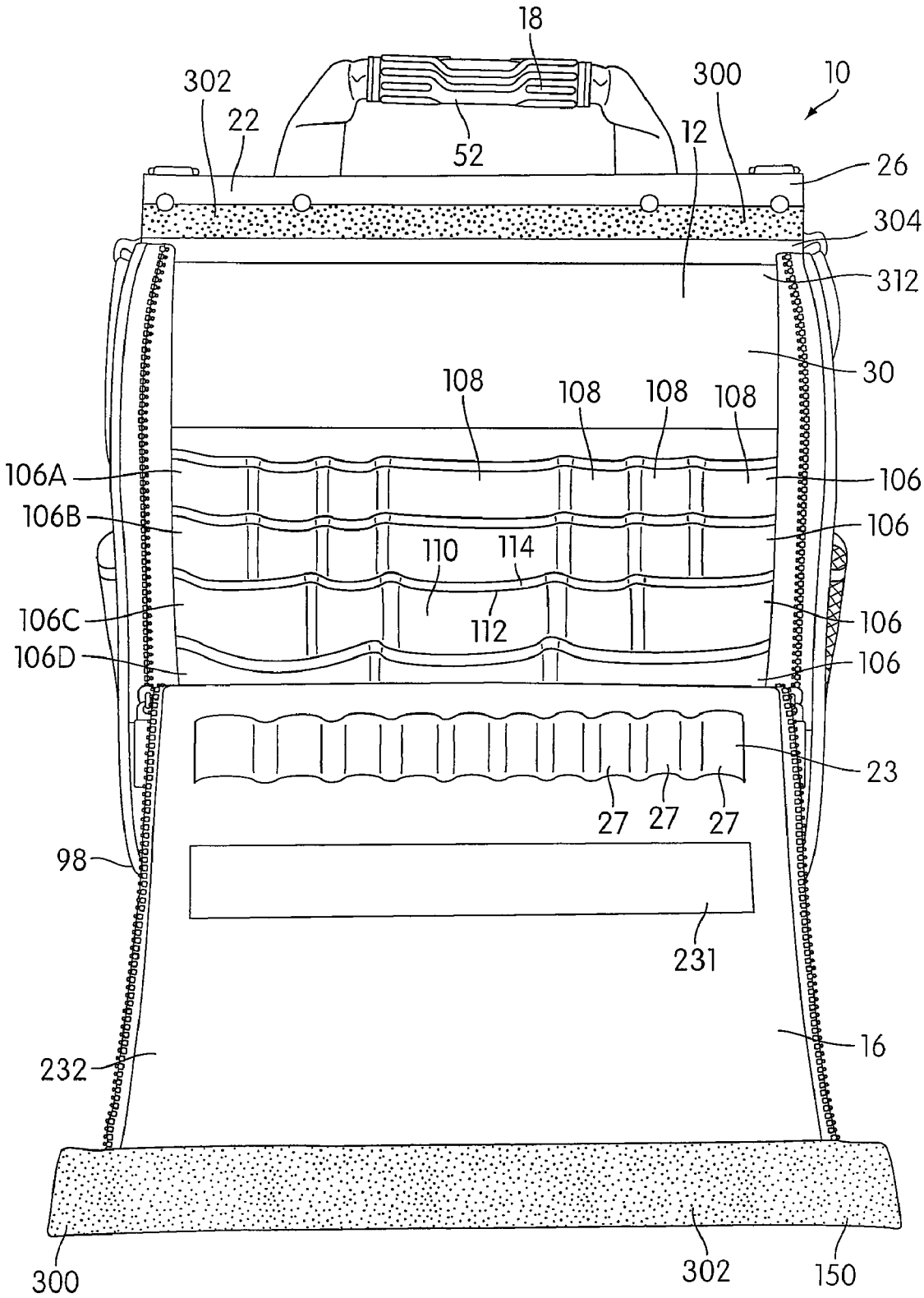
FIG. 8 is a front view of first storage section and an unrolled flexible cover.
Figure 9:
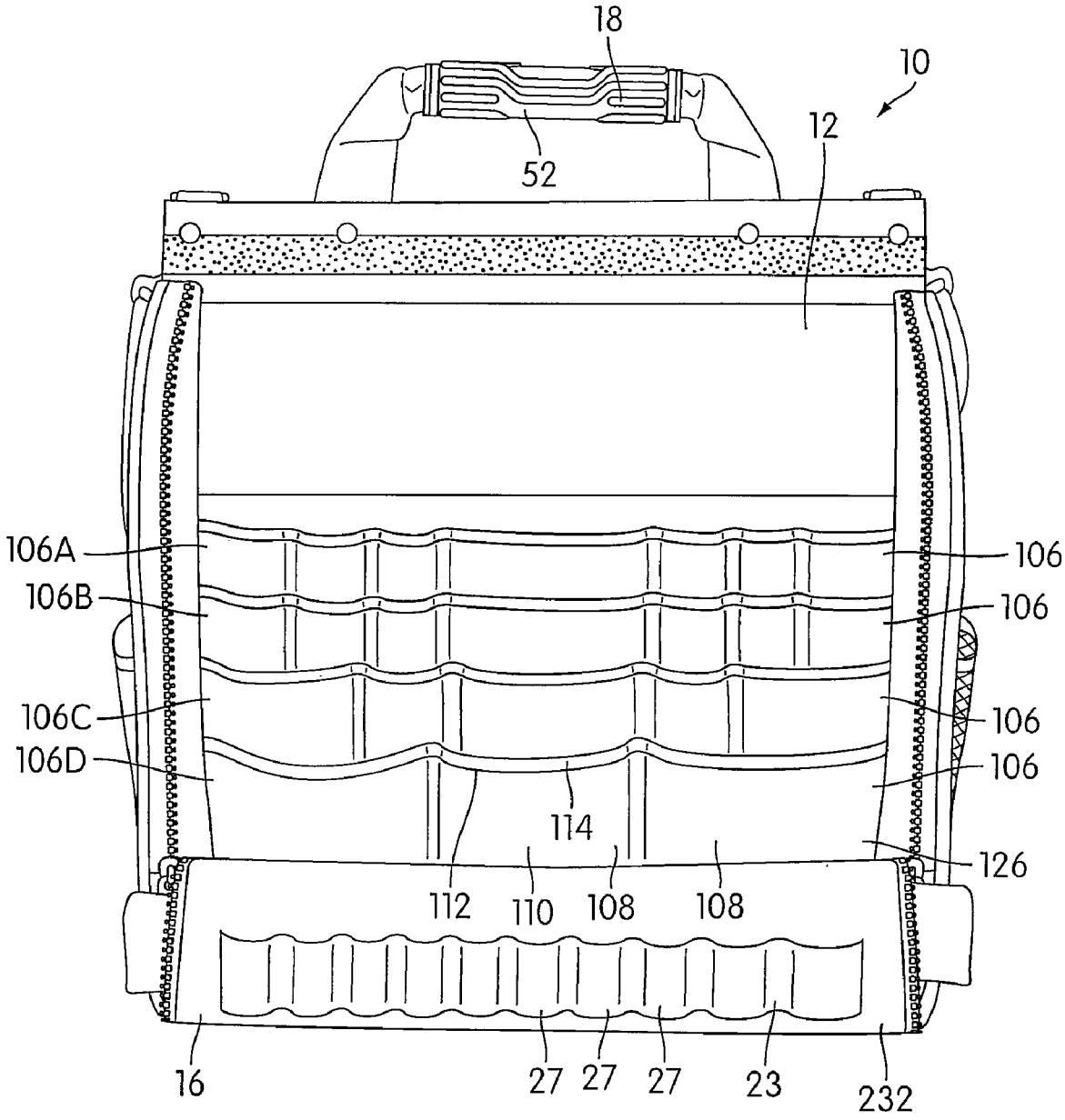
FIG. 9 is a front view of first storage section with the flexible cover disposed in a rolled configuration.

FIGS. 8 and 9 show a plurality of compartments 106 located in the first storage section 12 of the tool bag 10. Each compartment 106 located in the first storage section 12 includes a plurality of individual containing regions 108 arranged adjacent to each other along the length of the compartment 106. The individual containing regions 108 are formed by stitching or by otherwise attaching the compartment 106 at regular intervals along the length of the compartment 106. The individual containing regions 108 are adapted to organize one or more tools or articles in each individual containing region 108. The compartments 106 are arranged in a staged relationship, overlapping each other. In the illustrated embodiment, the first storage section 12 includes a first compartment 106A, a second compartment 106B, a third compartment 106C and a fourth compartment 106D. The compartments 106A-106D can be arranged in a staged relationship overlapping each other providing compartments for storing longer or larger tools or articles in deeper, more rearward compartments, such as the first compartment 106A, and for storing shorter or smaller tools or articles in other compartments, such as the second, the third and the fourth compartment 106B, 106C and 106D respectively. In one embodiment, each compartment 106 comprises a fabric panel 110 with an elastic strip 112 sewn or otherwise attached along upper edges 114 of the compartments 106. The elasticity of the elastic strip 112 allows each compartment 106 to be resiliently expanded from its relaxed configuration to accommodate and to support tools or articles of various sizes and shapes. It should be appreciated that it is within the scope of the present invention to provide only a single (at least one) compartment 106 within the storage section 12 or 14, or with individual containing regions 108 different than those illustrated herein and adapted to receive different types of items.

Figure 10:
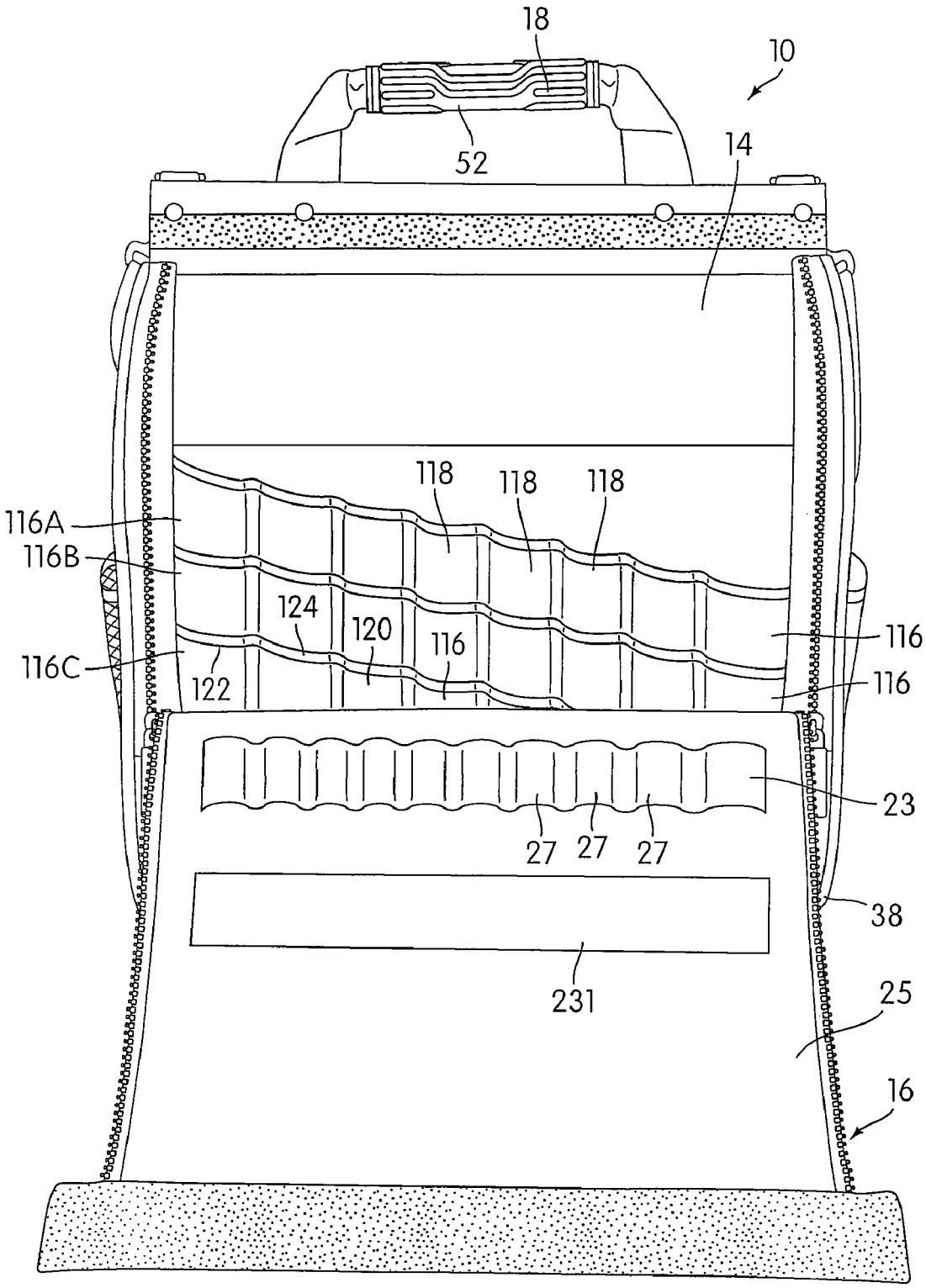
FIG. 10 is a front view of second storage section and an unrolled flexible cover.
Figure 11:
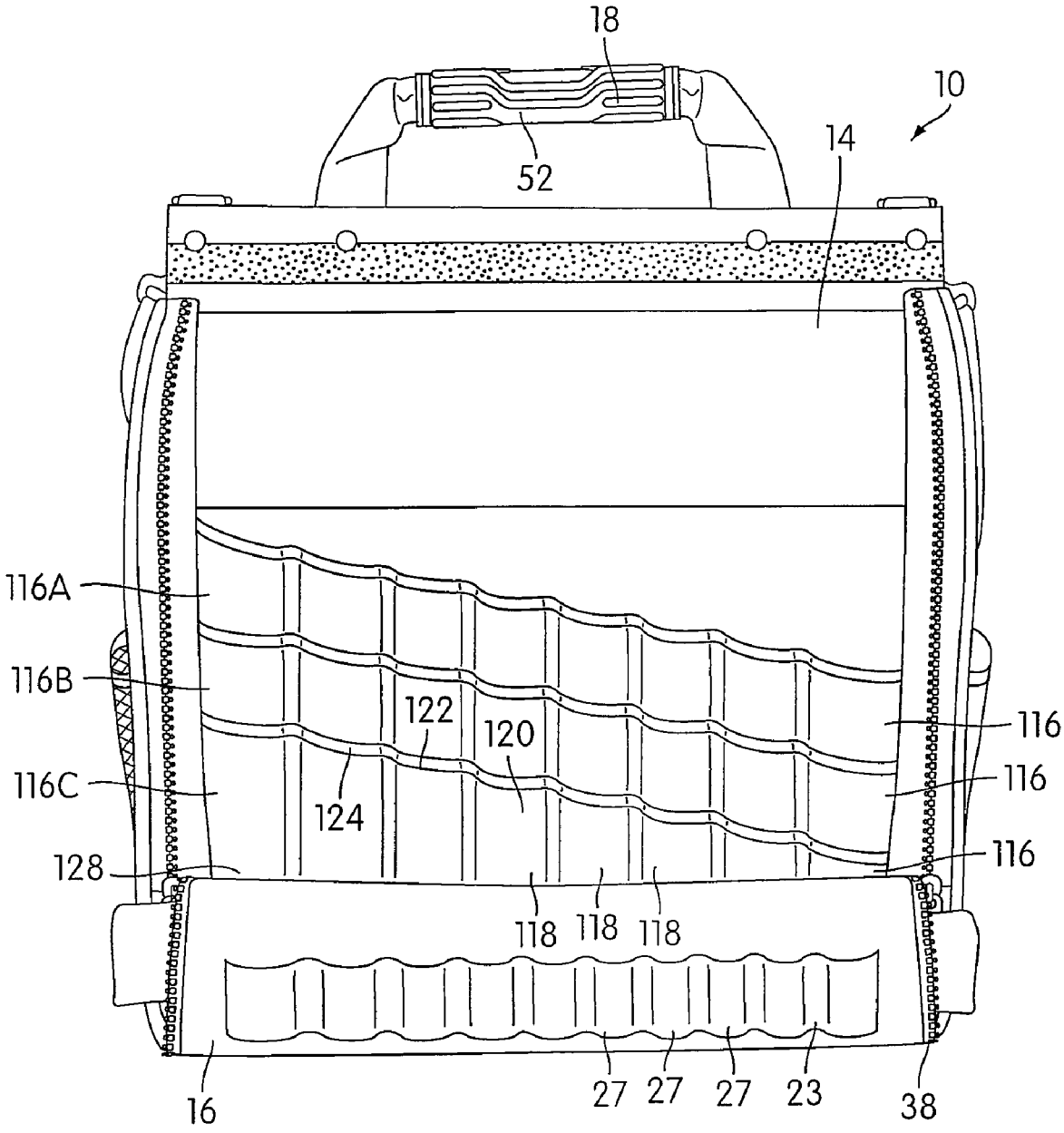
FIG. 11 is a front view of second storage section with the flexible cover disposed in a rolled configuration.

FIGS. 10 and 11 show a plurality of compartments 116 located in the second storage section 14 of the tool bag 10. Each compartment 116 located in the second storage section 14 includes a plurality of individual containing regions 118 arranged adjacent to each other along the length of the compartment 116. The individual containing regions 118 are formed by stitching or by otherwise attaching the compartment 116 at regular intervals along the length of the compartment 116. The individual containing regions 118 are adapted to organize one or more tools or articles in each individual containing region 118. Each compartment 116 is arranged in a staged relationship, overlapping each other. In the illustrated embodiment, the second storage section 14 includes a first compartment 116A, a second compartment 116B, and a third compartment 116C. The compartments 116A-116C can be arranged in a staged relationship overlapping each other providing compartments for storing longer or larger tools or articles in deeper, more rearward compartments, such as the first compartment 116A, and for storing shorter or smaller tools or articles in other compartments, such as the second, and the third compartment 116B, and 116C respectively. Each compartment 116 has an upper edge 124 defining an upwardly facing opening disposed at an angle with respect to the base wall 38 of the second storage section 14. The angle each upper edge 124 of compartment 116A-116C makes with the base wall 38 generally remains constant. In one embodiment, each compartment 116 is arranged such that the compartment 116 is sloping downwardly from left to right as shown in FIG. 10. In one embodiment, each compartment 116 comprises a fabric panel portion 120 with an elastic strip portion 122 sewn or otherwise attached along the upper edges 124 of the compartments 116. The elasticity of the elastic strip 122 allows each compartment 116 to be resiliently expanded from its relaxed configuration to accommodate and to support tools of various sizes and shapes. It should be appreciated that, in another embodiment, it is within the scope of the present invention to provide only a single (at least one) compartment 116 within either storage section, or with individual containing regions 118 different than those illustrated herein and adapted to receive different types of items.

As shown in the illustrated embodiments, in FIGS. 9 through 11, tools or articles may be stored in storage spaces 126 and 128 formed between the fourth compartment 106D of the first storage section 12 and the cover 16 (even in a completely rolled-down configuration), and the third compartment 116C of the second storage section 14 and the cover 16 (even in a completely rolled-down configuration) respectively.

Though the compartment structure has been explained with specific reference to either the first storage section 12 or the second storage section 14, it should be appreciated that it is within the scope of the present invention to provide the tool bag 10 having the compartments 106 in the second storage section 14, and the compartments 116 in the first storage section 12. In another embodiment, compartments 106 may be arranged in both the first and the second storage sections 12 and 14 respectively. In yet another embodiment, compartments 116 may be arranged in both the first and the second storage sections 12 and 14 respectively.

As shown in FIG. 8, the upper portion 150 of the flexible cover 16 includes a portion of VELCRO material, such as in the form of hook or loop material to enable connection with a region on or near the hinge region 22. For example, the upper portion 150 may include a first hook connector portion 300, which is constructed and arranged to connect with a first loop connector portion 302 located on a portion 304 of the first webbing 26, which is disposed on or near the upper portion 312 of a rear wall 30 of the first storage section 12 and/or near the hinge 22. In another embodiment, the end portion 150 of the flexible cover 16 may include the first loop connector portion 302, which is constructed and arranged to connect with the first hook connector portion 300 located on a portion 304 of the first webbing 26, which is disposed on or near the upper portion 312 of a rear wall 30 of the first storage section 12. In other words, the positions of the hook and loop material are interchangeable. The hook/loop connector portion 300 and the hook/loop connector portion 302 are configured to hold the upper edge 150 of the flexible cover 16 in a covering relation with the first storage section 12, when the flexible cover 16 is closed.

In one embodiment, as shown in FIG. 3, one or more hook/loop connector portion(s) 306 may be provided on the lower portion 92 (on an exterior surface of lower portion 92) of the first storage section 12. The hook/loop connector portion(s) 306 is constructed to connect with the hook/loop connector portion 231 on the inner surface 232 the flexible cover 16, slightly spaced from compartment 23 as seen clearly in FIG. 8, to hold the flexible cover 16 in a rolled down condition as seen in FIG. 9. Similarly, hook/loop connector portion(s) 306 may be attached near the lower portion 92 of the second storage section 12, while hook/loop material 231 is similarly provided on an inner surface 25 of the flexible cover 16 as shown in FIG. 10 to enable the flexible cover 16 to be retained in a rolled down condition as seen in FIG. 11. For convenience, the term "hook/loop connector" refers herein to either the hook or loop portion of VELCRO material, which is cooperable with the opposite type (loop or hook) material.

In another embodiment, a fastener device other than VELCRO can be used to retain one or both of the flexible covers 16 in a rolled down configuration. For example, in one embodiment, a snap connection can be used. In another embodiment, lace or string material can be used to tie or fasten the flexible cover 16 in the rolled down configuration.

Figure 12:
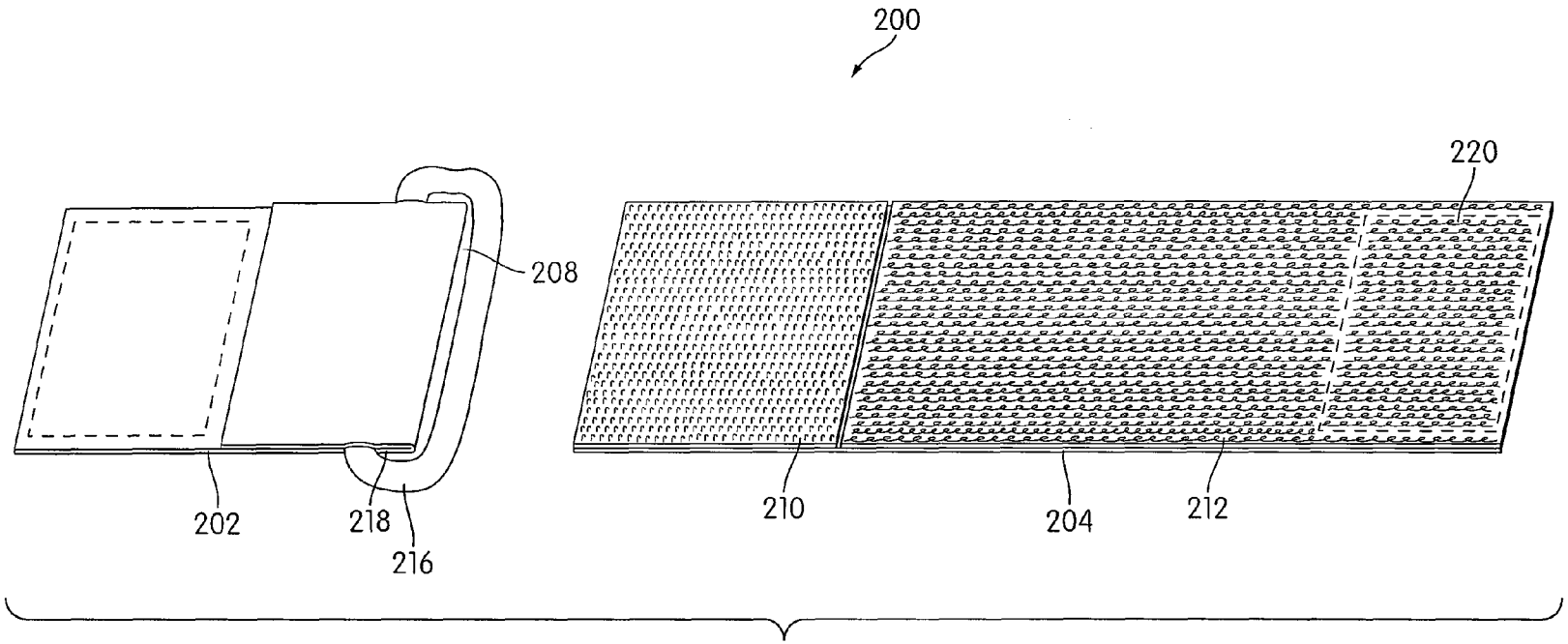
FIG. 12 is a schematic view of an adjustable fastening structure in accordance with an aspect of the present invention.
Figure 13:
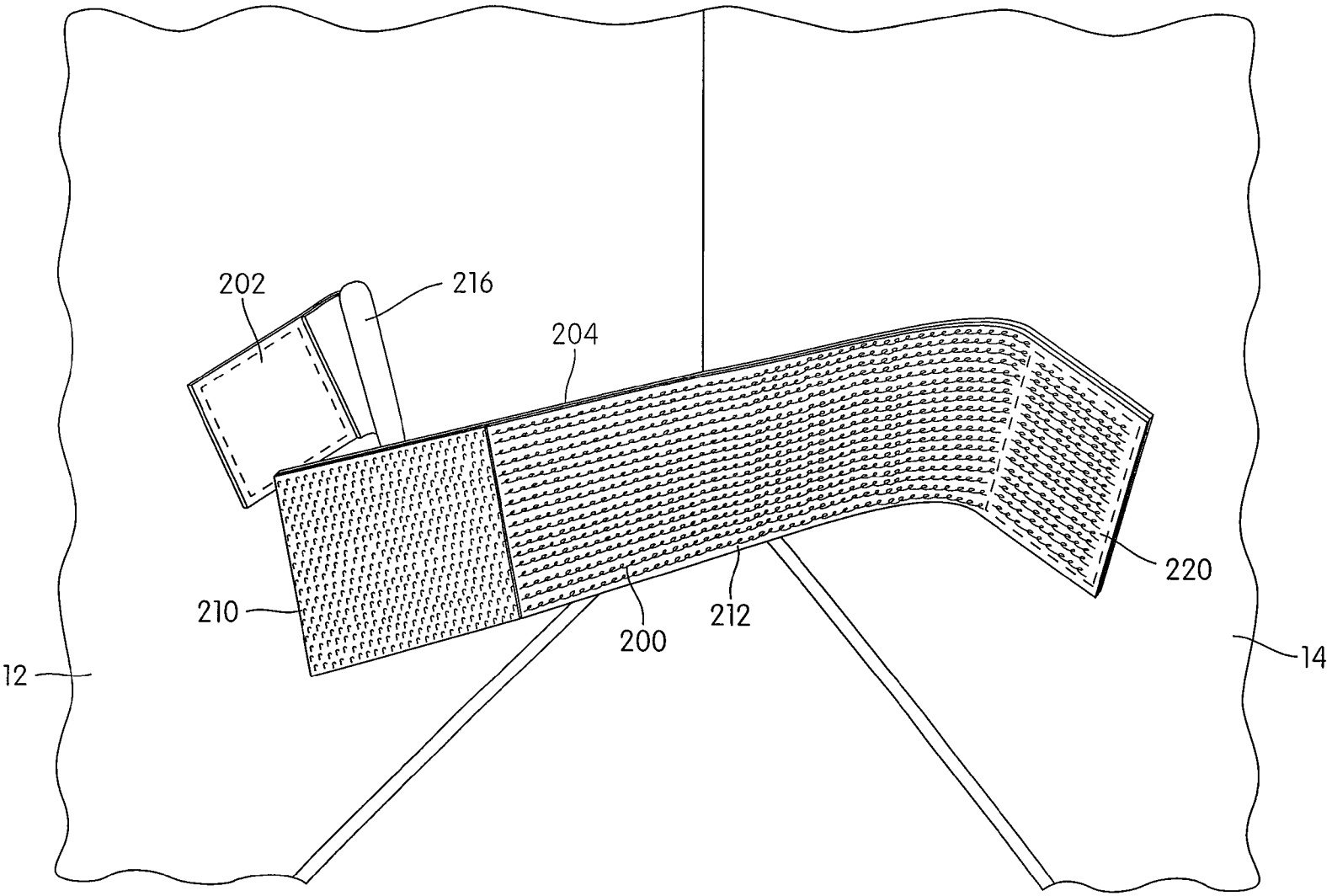
FIG. 13 is a perspective view of the adjustable fastening structure connected to the first and the second storage sections in accordance with an aspect of the present invention.

FIGS. 12 and 13 show the adjustable fastening structure 200, which is attached to both the first storage section 12 and the second storage section 14, in the region therebetween. The fastening structure 200 is constructed and arranged to adjust the permitted separation between the first storage section 12 and the second storage section 14, and to secure the tool bag 10 to the construction apparatus 20. The adjustable fastening structure 200 includes a first fastener portion 202 and a second fastener portion 204, each of which are releasably engaged with each other to connect the first storage section 12 and the second storage section 14. In one embodiment, the fastening structure 200 comprises an adjustable strap 200, and the strap 200 is divided into two strap portions 202 and 204. In one embodiment, the first fastener portion 202 is attached to the first storage section 12 and the second fastener portion 204 is attached to the second storage section 14. In an alternative embodiment, the first fastener portion 202 is attached to the second storage section 14 and the second fastener portion 204 is attached to the first storage section 12.

The first fastener portion 202 and the second fastener portion 204 may be attached to the storage section 12 or 14 by stitching or by other attachment as would be appreciated by one skilled in the art. The first fastener portion 202 includes a ring or loop 216 stitch at a distal end 218 thereof. The loop 216 defines an opening 208 constructed and arranged to receive an end portion 210 of the second fastener portion 204 therethrough. In one embodiment, the end 218 of the first fastener portion 202 is passed through at least a portion of the ring or loop 216 and is looped back onto itself and connected (e.g., stitched) to attach the ring or loop 216 with the first fastener portion 202. At least a first portion 210 of the second fastener portion 204 is constructed and arranged to pass through the opening 208 of the first fastener portion 202 to selectively couple with second portion 212 of the second fastener portion 204 and to connect the first storage section 12 with the second storage section 14. In one embodiment, the second fastener portion 204 can be inserted into opening 208 such that the hooks (e.g., male Velcro™) located on the rear section of the first portion 210 can engage with the loops (e.g., female Velcro™) on the second portion 212 of the second fastener portion 204, to secure the adjustable fastening structure 200 at the desired length. In one embodiment, the first portion 210 of the second fastener portion 204 includes a strip or a pad with a plurality of hooks, and the second portion 212 of the second fastener portion 204 includes a strip or a pad with a plurality of loops. The second fastener portion 204 is attached to the storage section 12 or 14 by stitching or by otherwise attaching at least a base or opposite end portion 220 of the second fastener portion 204 to the storage section 12 or 14.

In one embodiment, when the tool bag 10 is positioned over the construction apparatus 20, the first storage section 12 and the second storage section 14 are connected to each other such that the second fastener portion 204 surrounds a portion of the construction apparatus 20 before being connected to the first fastener portion 202, thus securing the tool bag 10 to the construction apparatus 20.

Figure 14A:
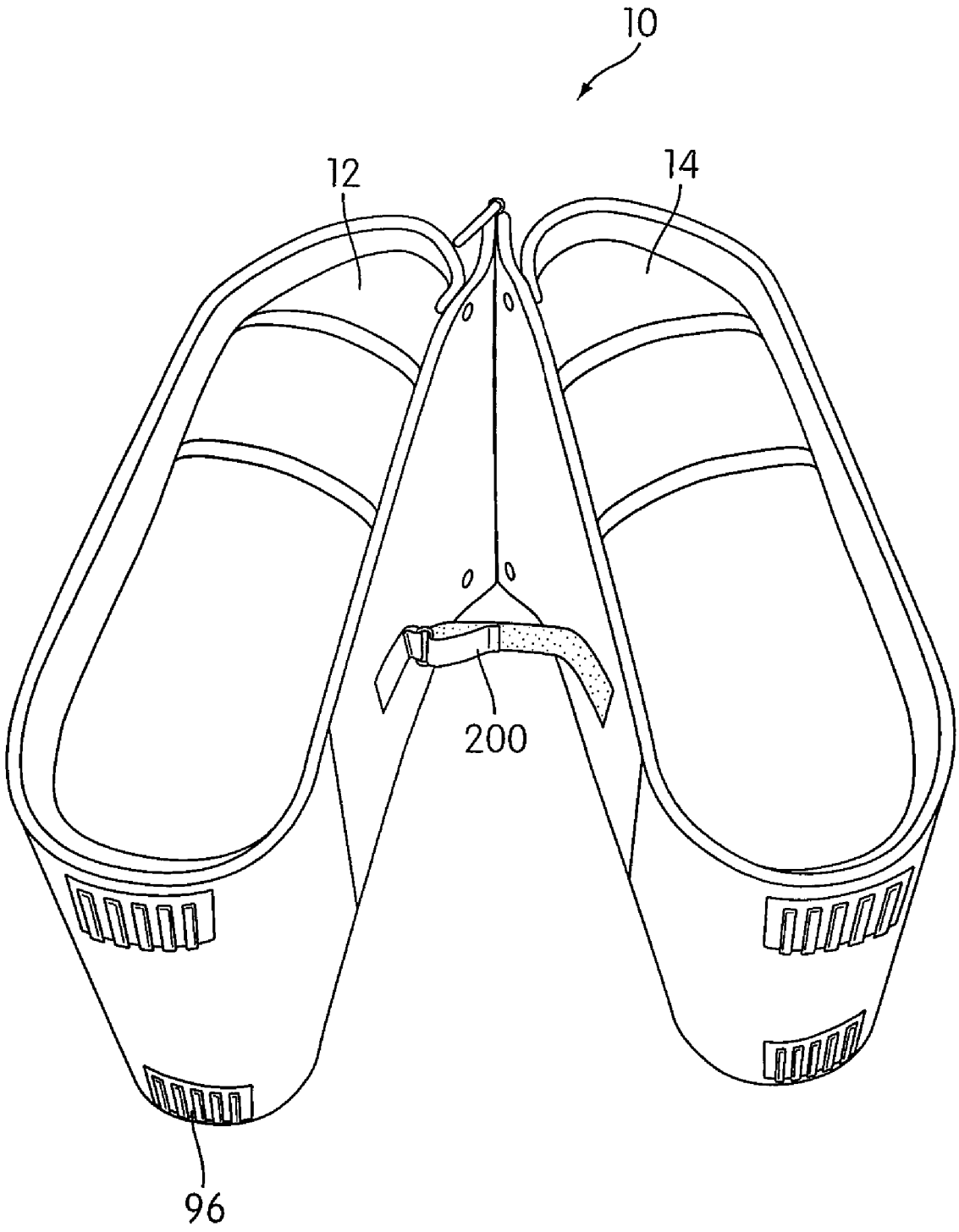
FIG. 14A is a perspective view of the tool bag in the extended configuration in accordance with an embodiment of the present invention.
Figure 14B:
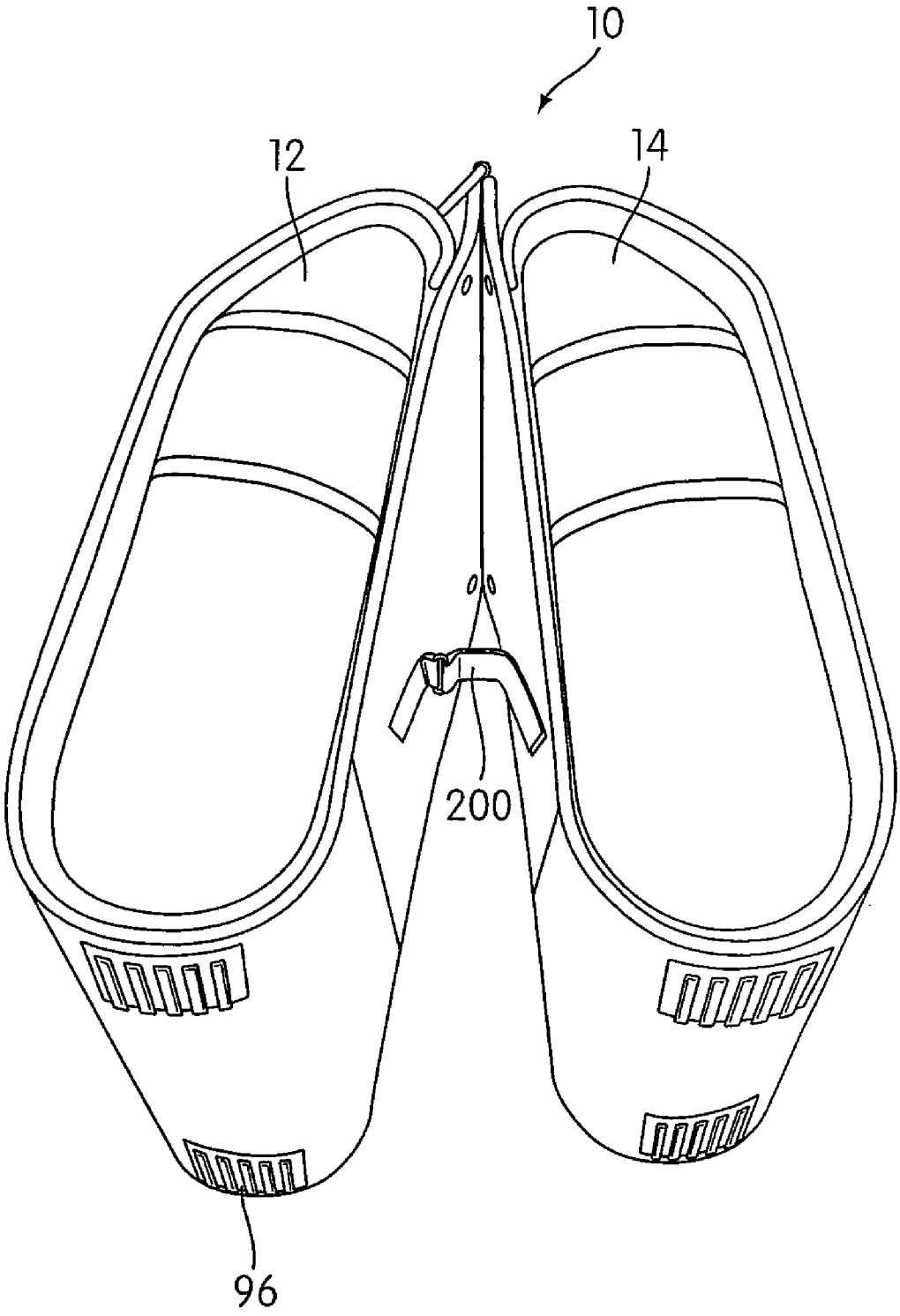
FIG. 14B is a perspective view of the tool bag in an intermediate configuration in accordance with an embodiment of the present invention.
Figure 14C:
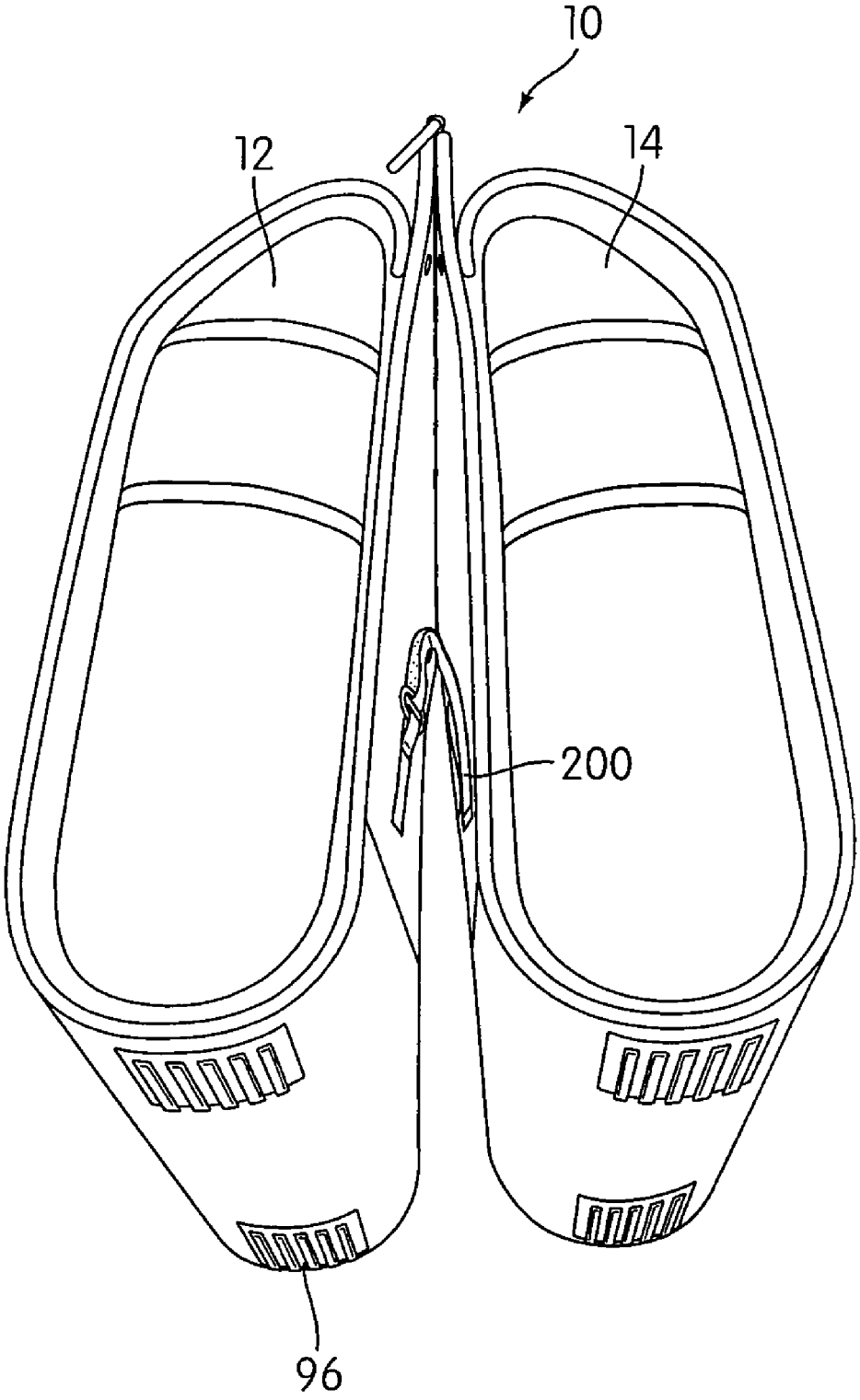
FIG. 14C is a perspective view of the tool bag in the compact configuration in accordance with an embodiment of the present invention.
Figure 15A:
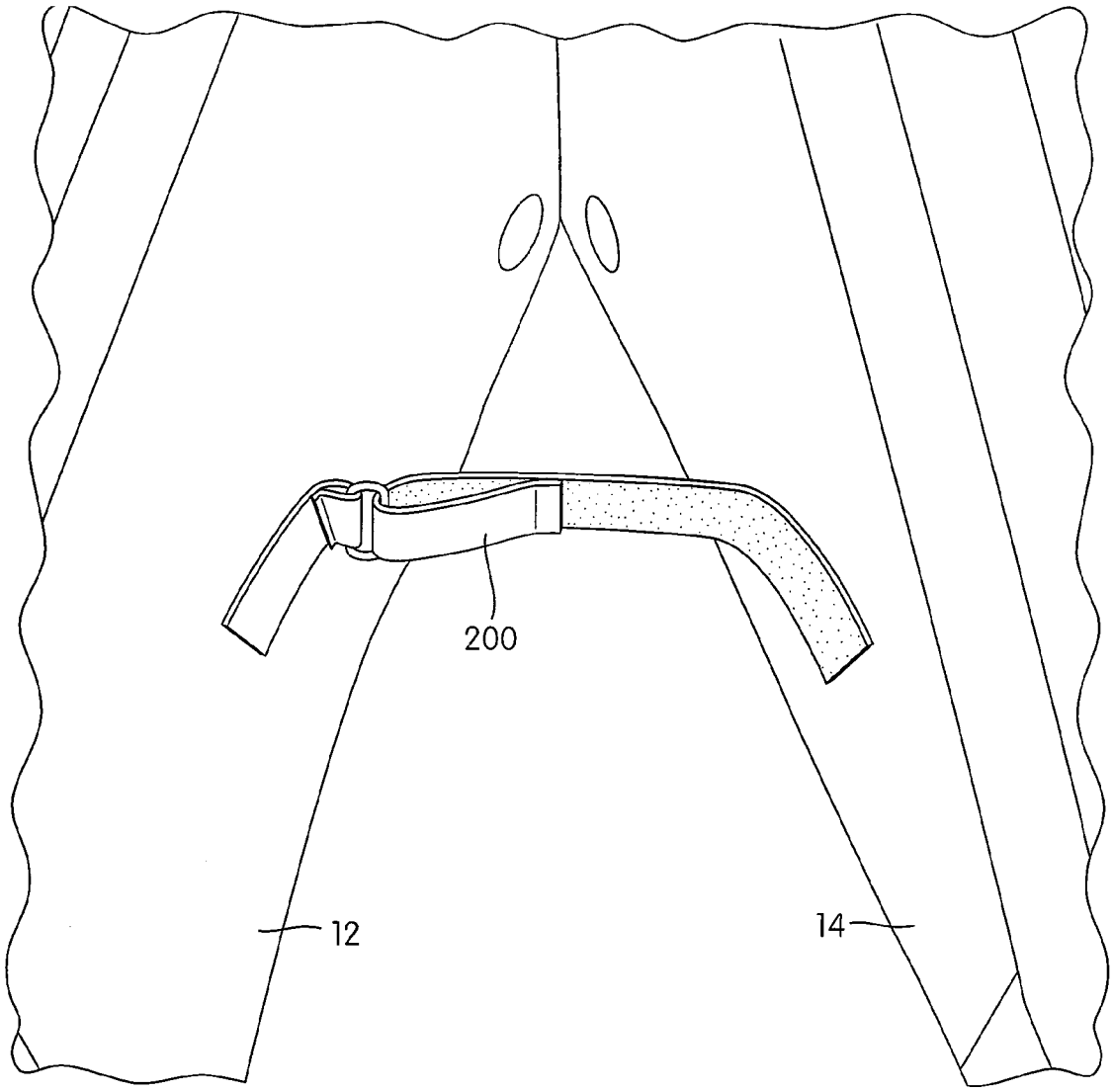
FIG. 15A is a perspective view of the adjustable fastening structure attached to the tool bag, when the tool bag in the extended configuration in accordance with an embodiment of the present invention.
Figure 15B:
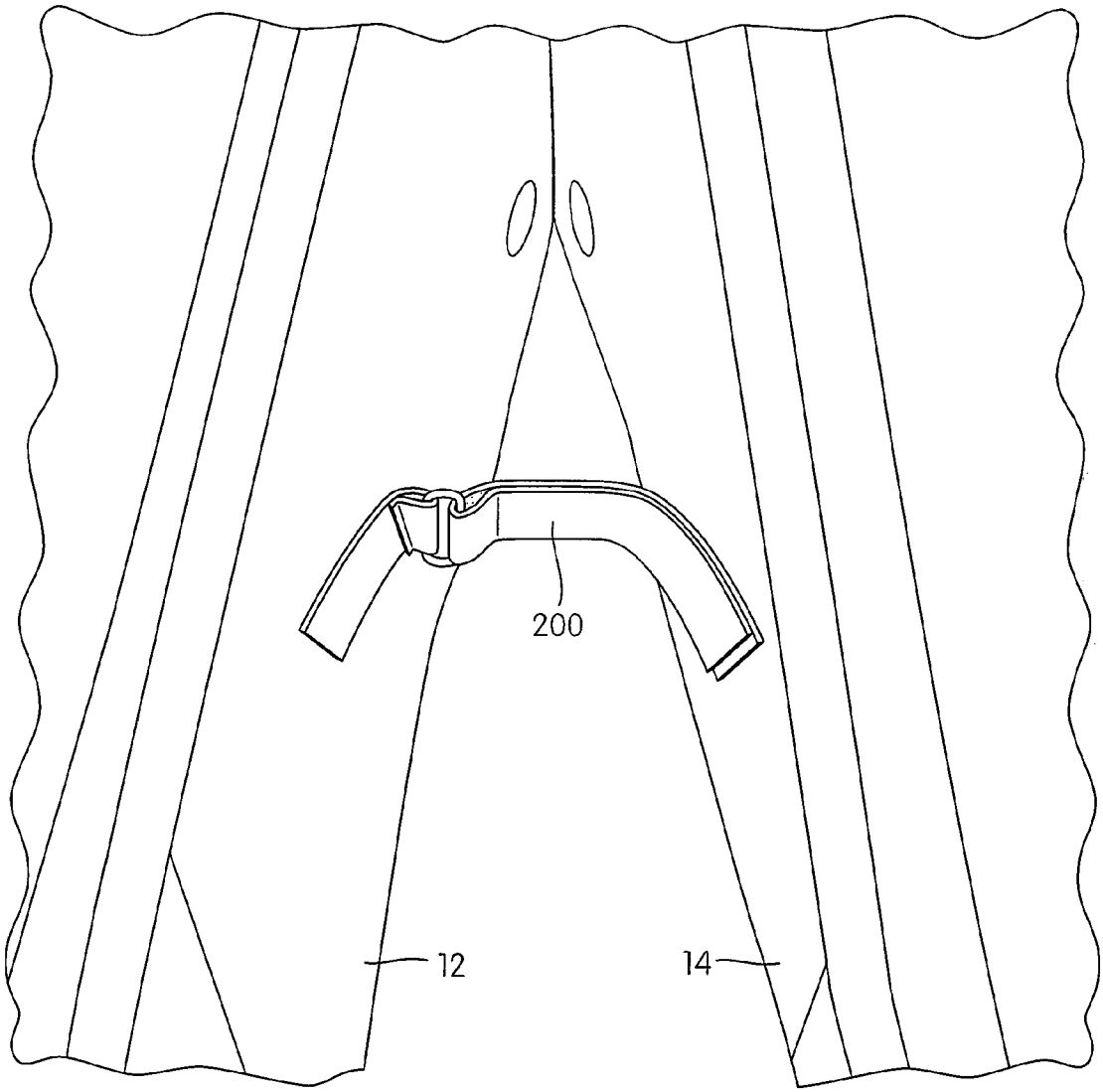
FIG. 15B is a perspective view of the adjustable fastening structure attached to the tool bag, when the tool bag in the intermediate configuration in accordance with an embodiment of the present invention.
Figure 15C:
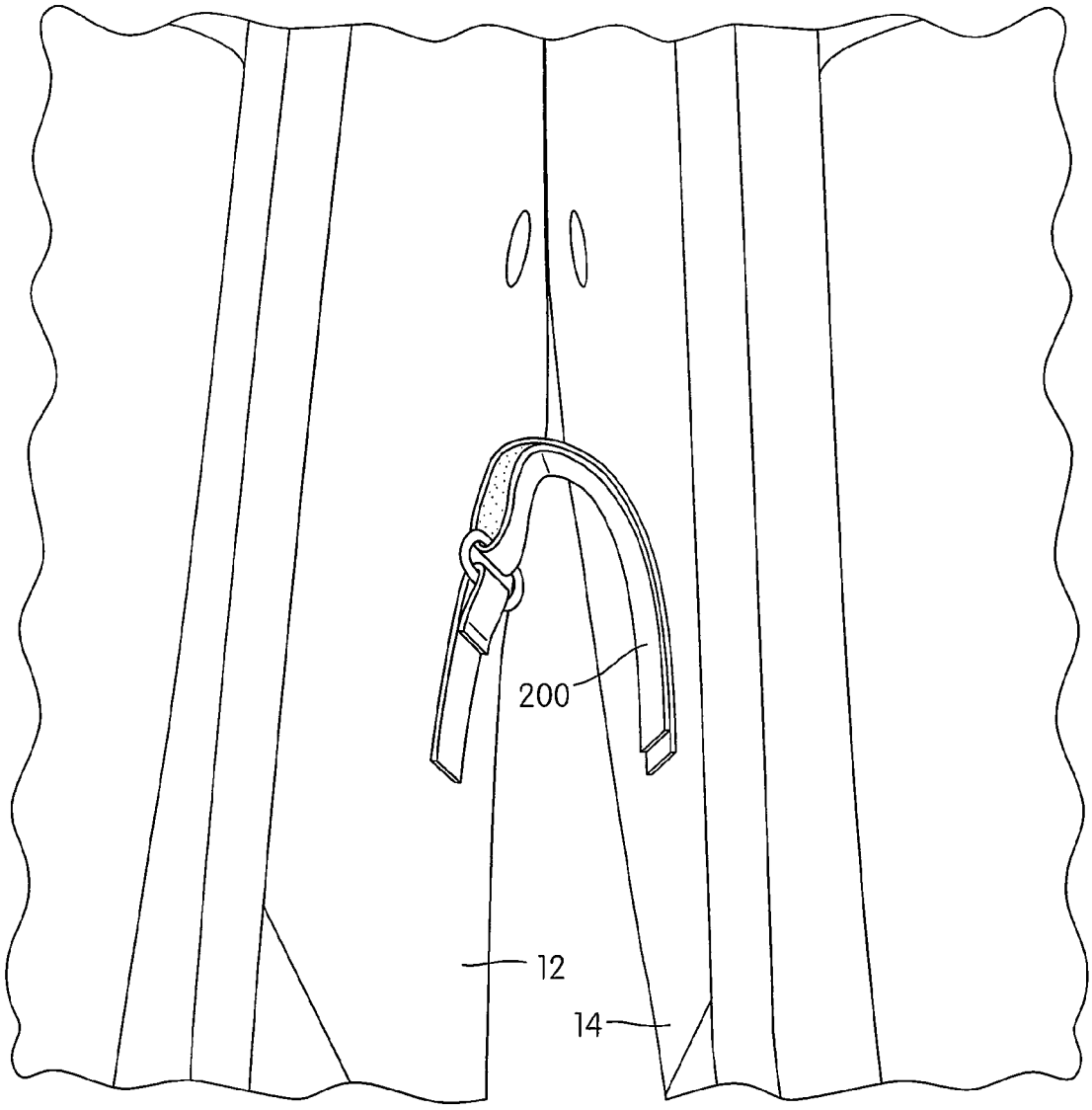
FIG. 15C is a perspective view of the adjustable fastening structure attached to the tool bag, when the tool bag in the compact configuration in accordance with an embodiment of the present invention.

FIGS. 14A-14C show the tool bag 10 in the standing, but in the extended configuration, an intermediate configuration, and a compact configuration respectively. In the extended configuration, the first storage section 12 and the second storage section 14 are separated such that the adjustable fastening structure 200 is in a relatively longer effective length or configuration, as shown in FIG. 15A. In the intermediate configuration, the first storage section 12 and the second storage section 14 are being separable such that the adjustable fastening structure 200 is in a relatively shorter effective length or configuration, as shown in FIG. 15B. In the compact configuration, the first storage section 12 and the second storage section 14 are in a side-by-side contacting relationship with each other such that the adjustable fastening structure 200 folds between the first storage section 12 and the second storage section 14, as shown in FIG. 15C, as the tool bag 10 is moved to the compact configuration.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A tool bag for transporting a plurality of tools and for positioning over construction apparatus such as a ladder, a sawhorse, or a scaffold rail, the bag comprising:

a first storage section and a second storage section pivotally connected to each other so as to generally define an upper hinge region, the first and second storage sections being separable so that they can be disposed on opposite sides of the construction apparatus, and being movable into close proximity with one another to enable the tool bag to be carried in a more compact configuration, each of the storage sections comprising a plurality of compartments for storing items;

at least one of the storage sections comprising a relatively rigid backing member and a flexible cover, the compartments being mounted on the relatively rigid backing member, and the flexible cover being constructed and arranged to cover the associated compartments of the storage section so as to prevent access to the stored items in the associated compartments, upper portions of the cover constructed and arranged to be removed from covering relation while lower portions of the cover remain attached, thereby exposing the compartments; and a handle having end portions, and connections that connect the end portions in proximity to the upper hinge region of the pivotally connected first and second storage sections to facilitate carrying of the tool bag in the compact configuration, wherein an interface between an upper portion of the relatively rigid backing member and an upper edge of the flexible cover is a non-zippered connection such that the upper portion of the relatively rigid backing member and the upper edge of the flexible cover are devoid of zippers to facilitate upward extraction of the stored items from the compartments mounted on the relatively rigid backing member.

2. The bag of claim 1, wherein the first storage section and the second storage section are disposed substantially side-by-side contacting relationship with each other, when the bag is placed in the compact configuration.

3. The bag of claim 1, wherein a plurality of compartments are constructed and arranged on a rear wall of the first storage section and on a rear wall of the second storage section.

4. The bag of claim 1, further comprising a plurality of skid resistant members, wherein each skid resistant member is located on a base wall of the first storage section and on a base wall of the second storage section to facilitate stability of the bag when placed in a standing configuration.

5. The bag of claim 1, wherein the compartments located in the first storage section comprise a plurality of individual containing regions arranged adjacent to each other to store one or more tools or articles.

6. The bag of claim 1, wherein an upper edge of the compartments located in the second storage section is disposed at an angle with respect to base wall of the second storage section.

7. The bag of claim 1, wherein the first and second storage sections each comprise a pair of side walls, and further comprising a compartment disposed on an exterior of one or more of the side walls.

8. The bag of claim 1, wherein the flexible cover comprises at least one compartment located on an outer surface for storing items.

9. The bag of claim 1, further comprising a first hook/loop connector portion disposed on an upper portion of the cover, and a second hook/loop connector portion disposed adjacent to or on the upper portion of the backing member of the associated storage section, the first hook/loop portion being connectable to the second hook/loop portion.

10. The bag of claim 1, wherein the connections comprise fasteners.

11. The bag of claim 1, wherein the compartments located in the first storage section are arranged in a staged relationship overlapping each other.

12. The bag of claim 11, wherein an upper edge of the compartments located in the first storage section is parallel to a base wall of the first storage section.

13. The bag of claim 1, further comprising a shoulder strap connected in proximity to the upper hinge region to facilitate carrying of the tool bag in the compact configuration.

14. The bag of claim 13, wherein the length of the shoulder strap is adjustable.

15. The bag of claim 1, further comprising a pair of zippers that extend along side edges of the flexible cover to retain the cover in said covering relation with the associated storage section.

16. The bag of claim 15, wherein each zipper comprises parallel zipper portions that are connected in an interlocking relation, wherein the zippers do not interfere with upward extraction of stored items.

17. The bag of claim 1, wherein the flexible cover comprises a plurality of individual containing regions arranged adjacent to each other in a row for storing items.

18. The bag of claim 17, wherein the plurality of individual containing regions are located on an inner surface of the flexible cover, wherein such containing regions on the inner surface of the flexible cover are presented for use when the flexible cover is in a rolled configuration.

19. The bag of claim 1, further comprising a fastener arranged to retain the flexible cover in a rolled down configuration.

20. The bag of claim 19, wherein the fastener comprises hook/loop connector material.

21. The bag of claim 1, wherein the hinge region comprises flexible fabric webbing.

22. The bag of claim 21, wherein the flexible fabric webbing is connected to another fabric webbing to provide the hinge region that enables the placement of the bag on the construction apparatus.

23. The bag of claim 22, wherein the flexible fabric webbings are connected to each other by adhesive bonding.

24. The bag of claim 22, wherein the flexible fabric webbings are sewn to each other.

25. The bag of claim 1, further comprising an adjustable fastening structure attached to the first storage section and the second storage section, wherein the fastening structure is constructed and arranged to adjust the separation between the storage sections, and to secure the bag to the construction apparatus.

26. The bag of claim 25, wherein the fastening structure comprises a first fastener portion and a second fastener portion, which are releasably engaged with each other to connect the first storage section with the second storage section.

27. The bag of claim 25, wherein the first fastener portion is attached to the first storage section and the second fastener portion is attached to the second storage section.

28. The bag of claim 25, wherein the first fastener portion comprises an opening constructed and arranged to receive a first portion of the second fastener portion therethrough.

* * * * *